US007566271B2

(12) United States Patent
Hostetler et al.

(10) Patent No.: US 7,566,271 B2
(45) Date of Patent: Jul. 28, 2009

(54) GAMING DEVICE HAVING A SELECTION GAME WITH MULTIPLE GROUPS OF POTENTIAL OUTCOMES

(75) Inventors: John D. Hostetler, Reno, NV (US); Randall D. Mead, Reno, NV (US); Wing Yee Ngan, Reno, NV (US)

(73) Assignee: IGT, Reno, NV (US)

( * ) Notice: Subject to any disclaimer, the term of this patent is extended or adjusted under 35 U.S.C. 154(b) by 762 days.

(21) Appl. No.: 10/897,462

(22) Filed: Jul. 22, 2004

(65) Prior Publication Data

US 2005/0054416 A1 Mar. 10, 2005

Related U.S. Application Data

(60) Provisional application No. 60/501,952, filed on Sep. 10, 2003.

(51) Int. Cl.
*A63F 9/24* (2006.01)

(52) U.S. Cl. ..... 463/25; 463/16; 463/20

(58) Field of Classification Search ..... 463/16, 463/25, 42

See application file for complete search history.

(56) References Cited

U.S. PATENT DOCUMENTS

| | | | |
|---|---|---|---|
| 4,448,419 | A | 5/1984 | Telnaes |
| 4,560,161 | A | 12/1985 | Hamano |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,033,744 | A | 7/1991 | Bridgeman et al. |

(Continued)

FOREIGN PATENT DOCUMENTS

| | | | |
|---|---|---|---|
| EP | 0874337 | A1 | 10/1998 |

(Continued)

OTHER PUBLICATIONS

Addams Family Advertisement and Article written by IGT, Strictly Slots, published in 2000.

(Continued)

*Primary Examiner*—John M Hotaling, II
*Assistant Examiner*—Masud Ahmed
(74) *Attorney, Agent, or Firm*—K&L Gates LLP

(57) ABSTRACT

A gaming device with a selection game that enables a player to pick one of a plurality of selections. An award, terminator or modifier associated with the picked selection is revealed to the player. If the picked selection is associated with a terminator, the selection game ends. If the picked selection is associated with an award or value, the revealed award or value is modified by each activated modifier to form at least one modified award. The modified award is then provided to the player. If the picked selection is associated with a modifier, then the revealed modifier is activated. Once activated, the modifier will modify each of the awards that are subsequently revealed during the selection game. Moreover, once a modifier is activated, the gaming device retroactively applies the activated modifier to each of the previously revealed awards or values. That is, each activated modifier will modify each of the revealed awards regardless of the order in which each modifier is activated or the order in which each award is revealed.

19 Claims, 19 Drawing Sheets

U.S. PATENT DOCUMENTS

| | | | | |
|---|---|---|---|---|
| 5,092,598 | A | 3/1992 | Kamille | |
| 5,178,390 | A | 1/1993 | Okada | |
| 5,205,555 | A | 4/1993 | Hamano | |
| 5,342,047 | A | 8/1994 | Heidel et al. | |
| 5,344,145 | A | 9/1994 | Chadwick et al. | |
| 5,407,200 | A | 4/1995 | Zalabak | |
| 5,449,173 | A | 9/1995 | Thomas et al. | |
| 5,456,465 | A | 10/1995 | Durham | |
| 5,524,888 | A | 6/1996 | Heidel | |
| 5,536,016 | A | 7/1996 | Thompson | |
| 5,542,669 | A | 8/1996 | Charron et al. | |
| 5,560,603 | A | 10/1996 | Seelig et al. | |
| 5,611,535 | A | 3/1997 | Tiberio | |
| 5,647,798 | A | 7/1997 | Falciglia | |
| 5,711,525 | A | 1/1998 | Breeding | |
| 5,743,524 | A | 4/1998 | Nannicola | |
| 5,766,074 | A | 6/1998 | Cannon et al. | |
| 5,769,716 | A | 6/1998 | Saffari et al. | |
| 5,772,509 | A | 6/1998 | Weiss | |
| 5,775,692 | A | 7/1998 | Watts et al. | |
| 5,788,573 | A | 8/1998 | Baerlocher et al. | |
| 5,813,911 | A | 9/1998 | Margolin | |
| 5,823,874 | A | 10/1998 | Adams | |
| 5,833,538 | A | 11/1998 | Weiss | |
| 5,848,932 | A | 12/1998 | Adams | |
| 5,851,148 | A | 12/1998 | Brune et al. | |
| 5,855,514 | A | 1/1999 | Kamille | |
| 5,873,781 | A | 2/1999 | Keane | |
| 5,882,261 | A | 3/1999 | Adams | |
| 5,902,184 | A | 5/1999 | Bennett | |
| 5,911,418 | A | 6/1999 | Adams | |
| 5,927,714 | A | 7/1999 | Kaplan | |
| 5,935,002 | A | 8/1999 | Falciglia | |
| 5,938,200 | A | 8/1999 | Markowicz et al. | |
| 5,947,820 | A | 9/1999 | Morro et al. | |
| 5,951,397 | A | 9/1999 | Dickinson | |
| 5,964,463 | A | 10/1999 | Moore, Jr. | |
| 5,965,827 | A | 10/1999 | Stanley | |
| 5,967,894 | A | 10/1999 | Kinoshita et al. | |
| 5,976,015 | A | 11/1999 | Seelig et al. | |
| 5,980,384 | A | 11/1999 | Barrie | |
| 5,984,781 | A | 11/1999 | Sunaga | |
| 5,996,997 | A | 12/1999 | Kamille | |
| 5,997,400 | A | 12/1999 | Seelig et al. | |
| 5,997,401 | A | 12/1999 | Crawford | |
| 6,004,207 | A | 12/1999 | Wilson, Jr. et al. | |
| 6,015,346 | A | 1/2000 | Bennett | |
| 6,019,369 | A | 2/2000 | Nakagawa et al. | |
| 6,033,307 | A | 3/2000 | Vancura | |
| 6,056,642 | A | 5/2000 | Bennett | |
| 6,059,289 | A | 5/2000 | Vancura | |
| 6,059,658 | A | 5/2000 | Mangano et al. | |
| 6,062,980 | A | 5/2000 | Luciano | |
| 6,081,759 | A | 6/2000 | Husby | |
| 6,089,976 | A | 7/2000 | Schneider et al. | |
| 6,089,977 | A | 7/2000 | Bennett | |
| 6,089,978 | A | 7/2000 | Adams | |
| 6,093,102 | A | 7/2000 | Bennett | |
| 6,102,798 | A | 8/2000 | Bennett | |
| 6,120,031 | A | 9/2000 | Adams | |
| 6,126,541 | A | 10/2000 | Fuchs | |
| 6,126,542 | A | 10/2000 | Fier | |
| 6,135,885 | A | 10/2000 | Lermusiaux | |
| 6,142,873 | A | 11/2000 | Weiss et al. | |
| 6,142,874 | A | 11/2000 | Kodachi et al. | |
| 6,142,875 | A | 11/2000 | Kodachi et al. | |
| 6,146,273 | A | 11/2000 | Olsen | |
| 6,149,156 | A | 11/2000 | Feola | |
| 6,149,521 | A * | 11/2000 | Sanduski | 463/13 |
| 6,155,925 | A | 12/2000 | Giobbi et al. | |
| 6,159,095 | A | 12/2000 | Frohm et al. | |
| 6,159,096 | A | 12/2000 | Yoseloff | |
| 6,159,097 | A | 12/2000 | Gura | |
| 6,159,098 | A | 12/2000 | Slomiany et al. | |
| 6,162,121 | A | 12/2000 | Morro et al. | |
| 6,168,520 | B1 | 1/2001 | Baerlocher et al. | |
| 6,168,523 | B1 | 1/2001 | Piechowiak et al. | |
| 6,173,955 | B1 | 1/2001 | Perrie et al. | |
| 6,174,233 | B1 | 1/2001 | Sunaga et al. | |
| 6,174,235 | B1 | 1/2001 | Walker et al. | |
| 6,179,711 | B1 | 1/2001 | Yoseloff | |
| 6,190,254 | B1 | 2/2001 | Bennett | |
| 6,190,255 | B1 | 2/2001 | Thomas et al. | |
| 6,203,429 | B1 | 3/2001 | Demar et al. | |
| 6,205,868 | B1 | 3/2001 | Miller | |
| 6,210,279 | B1 | 4/2001 | Dickinson | |
| 6,211,793 | B1 | 4/2001 | Smithson | |
| 6,213,876 | B1 | 4/2001 | Moore, Jr. | |
| 6,224,482 | B1 | 5/2001 | Bennett | |
| 6,224,483 | B1 | 5/2001 | Mayeroff | |
| 6,227,971 | B1 | 5/2001 | Weiss | |
| 6,230,088 | B1 | 5/2001 | Husby | |
| 6,231,442 | B1 | 5/2001 | Mayeroff | |
| 6,231,445 | B1 | 5/2001 | Acres | |
| 6,234,897 | B1 | 5/2001 | Frohm et al. | |
| 6,254,481 | B1 | 7/2001 | Jaffe | |
| 6,260,879 | B1 | 7/2001 | Stanley | |
| 6,261,177 | B1 | 7/2001 | Bennett | |
| 6,264,236 | B1 | 7/2001 | Aoki | |
| 6,270,409 | B1 | 8/2001 | Shuster | |
| 6,270,412 | B1 | 8/2001 | Crawford et al. | |
| 6,290,600 | B1 | 9/2001 | Glasson | |
| 6,296,568 | B1 | 10/2001 | Tracy | |
| 6,301,977 | B1 | 10/2001 | Stojanovski | |
| 6,302,790 | B1 | 10/2001 | Brossard | |
| 6,305,686 | B1 | 10/2001 | Perrie et al. | |
| 6,309,300 | B1 | 10/2001 | Glavich | |
| 6,312,334 | B1 | 11/2001 | Yoseloff | |
| 6,315,660 | B1 | 11/2001 | DeMar et al. | |
| 6,315,664 | B1 | 11/2001 | Baerlocher et al. | |
| 6,319,124 | B1 | 11/2001 | Baerlocher et al. | |
| 6,328,649 | B1 | 12/2001 | Randall et al. | |
| 6,336,371 | B1 | 1/2002 | O'Boyle | |
| 6,336,860 | B1 | 1/2002 | Webb | |
| 6,346,043 | B1 | 2/2002 | Colin et al. | |
| 6,347,996 | B1 | 2/2002 | Gilmore et al. | |
| 6,358,144 | B1 | 3/2002 | Kadlic et al. | |
| 6,363,793 | B2 | 4/2002 | O'Boyle | |
| 6,364,766 | B1 | 4/2002 | Anderson et al. | |
| 6,375,187 | B1 | 4/2002 | Baerlocher | |
| 6,398,644 | B1 | 6/2002 | Perrie et al. | |
| 6,400,145 | B1 | 6/2002 | Chamings | |
| 6,413,161 | B1 * | 7/2002 | Baerlocher et al. | 463/20 |
| 6,416,408 | B2 | 7/2002 | Tracy et al. | |
| 6,439,995 | B1 | 8/2002 | Hughs-Baird et al. | |
| 6,450,435 | B2 | 9/2002 | Junker | |
| 6,454,304 | B1 | 9/2002 | Steffens | |
| 6,454,651 | B1 | 9/2002 | Yoseloff | |
| 6,461,241 | B1 | 10/2002 | Webb et al. | |
| 6,464,582 | B1 | 10/2002 | Baerlocher et al. | |
| 6,471,208 | B2 | 10/2002 | Yoseloff et al. | |
| 6,481,750 | B1 | 11/2002 | Kalina | |
| 6,494,785 | B1 | 12/2002 | Gerrard et al. | |
| 6,502,860 | B1 | 1/2003 | Siegfried | |
| 6,506,118 | B1 * | 1/2003 | Baerlocher et al. | 463/25 |
| 6,514,141 | B1 | 2/2003 | Kaminkow et al. | |
| 6,561,904 | B2 | 5/2003 | Locke et al. | |
| 6,565,432 | B2 | 5/2003 | Moody | |
| 6,569,015 | B1 * | 5/2003 | Baerlocher et al. | 463/16 |
| 6,572,471 | B1 | 6/2003 | Bennett | |
| 6,575,830 | B2 | 6/2003 | Baerlocher et al. | |
| 6,585,591 | B1 | 7/2003 | Baerlocher et al. | |
| 6,595,854 | B2 | 7/2003 | Hughs-Baird et al. | |
| 6,599,185 | B1 | 7/2003 | Kaminkow et al. | |

| | | | | |
|---|---|---|---|---|
| 6,599,192 | B1 | 7/2003 | Baerlocher et al. | |
| 6,602,137 | B2 | 8/2003 | Kaminkow et al. | |
| 6,607,437 | B2 | 8/2003 | Casey et al. | |
| 6,607,438 | B2 | 8/2003 | Baerlocher et al. | |
| 6,609,971 | B2 * | 8/2003 | Vancura | 463/16 |
| 6,609,974 | B2 | 8/2003 | Mead et al. | |
| 6,632,141 | B2 | 10/2003 | Webb et al. | |
| 6,638,164 | B2 | 10/2003 | Randall et al. | |
| 6,648,754 | B2 | 11/2003 | Baerlocher et al. | |
| 6,685,561 | B2 | 2/2004 | Anderson et al. | |
| 6,719,630 | B1 | 4/2004 | Seelig et al. | |
| 6,733,386 | B2 | 5/2004 | Cuddy et al. | |
| 6,793,579 | B2 * | 9/2004 | Baerlocher et al. | 463/25 |
| 6,796,899 | B2 | 9/2004 | Baerlocher | |
| 7,235,011 | B2 * | 6/2007 | Randall et al. | 463/25 |
| 7,247,092 | B2 * | 7/2007 | Jarvis et al. | 463/13 |
| 2002/0025844 | A1 | 2/2002 | Casey et al. | |
| 2002/0045475 | A1 | 4/2002 | Glavich et al. | |
| 2002/0072402 | A1 | 6/2002 | Baerlocher | |
| 2002/0142822 | A1 | 10/2002 | Baerlocher et al. | |
| 2002/0145422 | A1 | 10/2002 | Chamings | |
| 2002/0148667 | A1 | 10/2002 | Feldman | |
| 2002/0151350 | A1 | 10/2002 | Baerlocher et al. | |
| 2002/0155883 | A1 | 10/2002 | Baerlocher | |
| 2002/0171234 | A1 | 11/2002 | Stephen | |
| 2002/0189365 | A1 | 12/2002 | Blakesley | |
| 2002/0189879 | A1 | 12/2002 | Jitsui | |
| 2003/0013514 | A1 | 1/2003 | Cregan et al. | |
| 2003/0040355 | A1 | 2/2003 | Baerlocher | |
| 2003/0040360 | A1 * | 2/2003 | Kaminkow | 463/25 |
| 2003/0045344 | A1 | 3/2003 | Webb et al. | |
| 2003/0045348 | A1 * | 3/2003 | Palmer et al. | 463/25 |
| 2003/0045350 | A1 | 3/2003 | Baerlocher et al. | |
| 2003/0060260 | A1 | 3/2003 | Gerrard et al. | |
| 2003/0064777 | A1 | 4/2003 | Baerlocher et al. | |
| 2003/0064795 | A1 | 4/2003 | Baerlocher et al. | |
| 2003/0078093 | A1 | 4/2003 | Simms et al. | |
| 2003/0087693 | A1 | 5/2003 | Baerlocher et al. | |
| 2003/0157982 | A1 | 8/2003 | Gerrard et al. | |
| 2003/0162578 | A1 | 8/2003 | Baerlocher et al. | |
| 2003/0162584 | A1 | 8/2003 | Hughs-Baird et al. | |
| 2003/0181233 | A1 * | 9/2003 | Baerlocher et al. | 463/16 |
| 2003/0199314 | A1 | 10/2003 | Baerlocher et al. | |
| 2003/0224846 | A1 | 12/2003 | Baerlocher | |
| 2004/0009805 | A1 | 1/2004 | Baerlocher et al. | |
| 2004/0038724 | A1 | 2/2004 | Asdale | |

FOREIGN PATENT DOCUMENTS

| | | | |
|---|---|---|---|
| EP | 0926645 | A2 | 6/1999 |
| EP | 0944030 | A2 | 9/1999 |
| EP | 0945837 | A2 | 9/1999 |
| EP | 0981119 | A2 | 2/2000 |
| EP | 0984408 | A2 | 3/2000 |
| EP | 0984409 | A2 | 3/2000 |
| EP | 1247704 | A2 | 10/2002 |
| GB | 2 144 644 | | 3/1985 |
| WO | WO 97/32285 | | 9/1997 |
| WO | WO 00/12186 | | 3/2000 |
| WO | WO 2004/060512 | A1 | 7/2004 |

OTHER PUBLICATIONS

Adders and Ladders Advertisement written by Barcrest Ltd., published prior to 2000.

Big Bang Piggy Bankin Advertisement written by WMS Gaming, Inc., published prior to 2000.

By George written by IGT, published in 2002.

Cash Box Advertisement & Article written by Anchor Games, Strictly Slots, published in 2000.

Chutes & Ladders Game Instructions written by Hasbro-Milton Bradley, published in 1999.

Fire and Fortune Article written by Strictly Slots, published in 2001.

Fox "N" Hound Advertisement written by IGT, published in 2000.

Jackpot Party Brochures and Articles, written by WMS Gaming, Inc., published in 1998.

Little Green Men Advertisement and Article written by IGT, Strictly Slots, published in 2000.

Monopoly Brochures and Articles, written by WMS Gaming, Inc., published in 1998.

Monopoly Party Train Article written by Strictly Slots, published in 2002.

Neon Nights written by IGT, published in 2000.

Price is Right "Showcases" Description written by schuminweb.com (web site), printed Mar. 16, 2001.

Richard Petty Advertisement written by IGT, published in 2000.

Spell Binder Advertisement by IGT, published in 2000.

Take Your Pick Article written by Strictly Slots, published in Mar. 2001.

Take Your Pick Advertisement written by IGT/Anchor Gaming, published in 1999.

Texas Tea Advertisement written by IGT, published in 2000.

Top Dollar Brochure, written by IGT, published in 1999.

* cited by examiner

GAMING DEVICE HAVING A SELECTION GAME WITH MULTIPLE GROUPS OF POTENTIAL OUTCOMES

PRIORITY CLAIM

This application is a non-provisional application of, claims priority to and the benefit of U.S. Provisional Patent Application Ser. No. 60/501,952, filed on Sep. 10, 2003, which incorporated herein in its entirety.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

Gaming device manufacturers strive to make gaming devices that provide as much enjoyment and excitement as possible. Providing a secondary or bonus game in which a player has an opportunity to win potentially large awards or credits in addition to the awards associated with the primary or base game of the gaming device is one way to enhance player enjoyment and excitement.

Gaming devices having bonus games generally employ a triggering event that occurs during the base game. The triggering event temporarily stalls or halts the base game play and enables a player to enter a second, different game, which is the bonus game. The player plays the bonus game, likely receives an award and returns to the base game.

Gaming devices and bonus rounds of gaming devices generally provide positive responses to inputs such as a player's selection. That is, when a player makes a choice in a gaming device by pressing a button or using another input device, the game normally continues play or awards a value associated with the button or input device. The player keeps or wins that which the player chooses. One example of such a game is a video poker game. In a standard video poker game, for example, the game deals the player a plurality of cards, the player selects one or more desired cards and the game continues play with the selected cards.

In known bonus games, when the game or player chooses from a plurality of awards, the game discards, discontinues using or does not award that which the player does not choose. European Patent Application No. EP 0 945 837 A2 filed on Mar. 18, 1999 and assigned on its face to WMS Gaming, Inc. discloses a bonus scheme of this type. A player has one or more opportunities to choose masked bonus awards from a group of symbols displayed to the player. When the player chooses a masked symbol, the game removes the mask and either awards the player with a bonus value or terminates the bonus round. The outcome depends upon whether the player selects an award or a terminator. To increase excitement and enjoyment, the game may reveal the contents of unselected symbols, however, the values of the unselected symbols do not mathematically factor into the player's award.

A need exists to provide new selection games for gaming devices that enable a player to obtain awards based on picking one or more masked selections.

SUMMARY OF THE INVENTION

The present invention relates in general to a gaming device, and more particularly to a gaming device having a selection game with multiple groups of potential outcomes.

In one embodiment of the present invention, the gaming device indicates or displays a plurality of selections. The gaming device includes a plurality of awards or values and at least one terminating event such as a terminator. The gaming device also includes a plurality of different modifiers. In one embodiment, the gaming device initially selects and activates at least one of the plurality of modifiers. Each of the awards, each of the remaining non-selected modifiers (i.e., each inactive modifier) and each of the terminators are each associated with one of the plurality of selections. Each selection is preferably masked and thus the award, modifier or terminator associated with each selection is not initially revealed or displayed to the player.

Upon the initiation of the selection game, the gaming device enables the player to pick one of the selections. The award, terminator or modifier associated with the picked selection is revealed to the player. If the picked selection is associated with a terminator, the selection game ends.

If the picked selection is associated with an award or value, the revealed award or value is modified by each activated modifier to form at least one modified award. The modified award is then accumulated for or provided to the player. For each activated modifier, the player will be provided a modified award that is based on the revealed award or value and the activated modifier. That is, the player will be provided a separate award for each activated modifier being applied to each revealed award or value. For example, if the gaming device initially activates a 1× modifier and the player's picked selection reveals an award or value of five, then the revealed award of five is modified by the 1× modifier to form or produce a modified award of five. The modified award is then accumulated for or provided to the player. Moreover, if the 1× modifier and a 3× modifier are both activated and the award of five is revealed to be associated with the player's picked selection, then the revealed award of five is modified by the activated 1× modifier to form or produce a modified award of five and the revealed award of five is also modified by the activated 3× modifier to form or produce a modified award of fifteen. The player is provided both modified awards (i.e., one award for each activated modified applied to each revealed award).

If the picked selection is associated with a modifier, then the revealed modifier is activated. Once activated, as described above, the modifier will modify each of the awards that are subsequently revealed during the selection game. For example, if a 3× modifier is revealed and activated with the player's second pick of the selections, then each of the awards revealed with each of the player's subsequent picks of the selections will be modified by the activated 3× modifier. Moreover, in one embodiment, once a modifier is activated, the gaming device retroactively applies that activated modifier to each of the previously revealed awards or values. That is, if a modifier is activated after the gaming device has already revealed and provided the player an award associated with a previously picked selection (i.e., the modifier was inactive when the award was first revealed), the subsequently activated modifier will still be retroactively applied to the previously revealed award. In other words, each activated modifier will modify each of the revealed awards regardless of the order in which each modifier is activated or the order in which each award is revealed. For example, if a 3× modifier was inactive at the time that the player's first pick revealed an award amount of ten and the 3× modifier subsequently becomes activated (i.e., by the player subsequently picking the selection associated with the 3× modifier), then the activated 3× modifier will be retroactively applied to the previously revealed award of ten to produce a modified award of thirty. The modified award of thirty is accumulated for or provided to the player.

In one embodiment, the gaming device also indicates or displays a plurality of groups, boards or levels that are each associated with one of the plurality of different modifiers. This embodiment includes multiple different levels of different modifiers. In this embodiment, when a modifier is activated, the group, board or level associated with the activated modifier is also activated. Each board is adapted to display each of the selected plurality of awards. Once activated, each group, board or level will display any revealed awards and any modified awards that are based on the revealed awards and the associated activated modifier.

After modifying the revealed award by each activated modifier or after activating the revealed modifier and retroactively applying the activated modifier to each of the previously revealed awards, the gaming device determines if all of the associated awards and all of the associated modifiers have been revealed. If all of the awards and all of the modifiers have been revealed, the selection game ends. In one embodiment, the player is provided an additional award or value for successfully revealing a designated number, such as all of the awards and all of the modifiers without first revealing a terminator. If all of the awards and all of the modifiers have not been revealed (i.e., at least one masked selection remains), the gaming device enables the player at least one subsequent pick of the plurality of selections.

The selection game proceeds with enabling the player to continue picking selections until a terminating event occurs. That is, the player is enabled to pick selections until either a terminator is revealed or all of the associated awards and all of the associated modifiers have been revealed. As described above, each award or value revealed with each subsequent pick is modified by each activated modifier and each modifier revealed and activated with each subsequent pick is retroactively applied to each of the previously revealed awards or values.

In an alternative embodiment, the gaming device provides the player a number of picks of said selections to obtain awards and/or modifiers. In this embodiment, none of the selections are associated with terminators and the player is enabled to pick selections to reveal awards and/or modifiers until the player picks a selection for each provided number of picks. In another embodiment, the gaming device provides the player a number of picks and also associates at least one terminator with at least one of said selections. In this embodiment, the selection game ends when the player has picked a selection for each provided number of picks or when a terminator is revealed to be associated with one of the player's picked selections.

In an alternative embodiment of the present invention, at the initiation of the selection game, one of the plurality of modifiers is not activated and each of the modifiers are associated with one of the plurality selections. In this embodiment, if no modifier is activated, the award or value associated with each of the player's picked selections is accumulated for or provided to the player. If, during the course of the selection game, at least one modifier is activated, then the award or value associated with each of the player's picked selections is accumulated for or provided to the player along with at least one modified award. It should be appreciated that as described above, each activated modifier will modifier each subsequently revealed award as well as retroactively modify each previously revealed award. This embodiment proceeds as described above until either a terminator is revealed or all of the associated awards and all of the associated modifiers have been revealed.

In another embodiment, the gaming device randomly selects awards, modifiers or terminators. In this embodiment, since the player has no control over which award, modifier or terminator is selected, the awards, modifiers and terminators are not associated with selections. Rather, the gaming device selects and reveals each award, modifier or terminator. In another embodiment, each award, modifier and terminator is associated with a probability of being selected. In this embodiment, the gaming device selects each award, modifier or terminator based on the associated probabilities.

In another embodiment of the present invention, the gaming device includes a plurality of symbols and a plurality of levels rather than a plurality of awards or values and a plurality of modifiers. In this embodiment, for each level, each symbol is associated with an award or value. That is, as described in more detail below, rather than modifying each revealed award by each activated modifier, in this embodiment, the player is provided the award or value associated with each revealed symbol for each activated level.

In this embodiment, if a player picked selection is revealed to be associated with a symbol, the player is provided the award associated with the revealed symbol for each activated level. For example, the "B" symbol of the first level is associated with an award or value, the "B" symbol of the second level is associated with a different award or value and the "B" symbol of the third level is associated with another different award or value. If the player's selection reveals the "B" symbol and if the second level is activated, then the player is provided the award that is associated with the "B" symbol of the second level. It should be appreciated that the award associated with one symbol for one level need not be mathematically related to the award associated with the same symbol for another level. That is, unlike the embodiment described above wherein there is a relationship between the revealed award and each activated modifier (i.e., the revealed award multiplied by each activated modifier), in this embodiment, the award associated with each symbol for each level may be independently determined. For example, the award associated with the "B" symbol of the second level is determined independently of the award associated with the "B" symbol on the first level and the award associated with the "B" symbol on the third level.

In this embodiment, as described above with respect to retroactively modifying each previously revealed award by each subsequently activated modifier, as each level is activated the player is provided the award associated with each previously revealed symbol for each activated level. For example, if the player previously revealed the "B" symbol and the player's next selection reveals and activates the third level, then the award associated with the "B" symbol for the third level is provided to the player. In one embodiment, the gaming device displays how each of the revealed symbols are associated to one another between the different levels. In one embodiment, the gaming device displays each of the related revealed symbols, such as each revealed "B" symbol, at a designated location for each activated level. In other embodiments, the gaming device may display each of the related revealed symbols as related pictures (e.g., pieces of a common puzzle), as related elements (e.g., cats and dogs) or in any other suitable manner which displays the associations between each related revealed symbol and the levels.

As described above, the selection game of this embodiment proceeds with enabling the player to continue picking selections until a terminating event occurs. That is, the player is enabled to pick selections until either a terminator is revealed or all of the associated symbols and all of the associated levels have been revealed.

In another embodiment of the present invention, each of the plurality of awards or values is paired or matched up with another one of the plurality of awards to form a set or pair. In this embodiment, each award in each set or pair is related or linked to the other award in the set or pair. That is, in one set, the first award of a set is a value and the second award of the set is a modified value which is the first award modified by a modifier. The gaming device also provides at least one terminator. In this embodiment, the gaming device associates each award or value and each terminator with one of a plurality of selections. As described above, each selection is masked so that the player cannot determine which selection is associated with which award or terminator.

Upon the initiation of this embodiment of the selection game, the gaming device enables the player to pick one of the masked selections. The gaming device reveals the award or terminator associated with the masked selection. If the player picked selection is associated with a terminator, then the selection game ends. If the player picked a selection associated with one of the plurality of awards or values, then the award or value related to the revealed award or value is also revealed. The gaming device provides the player the award or value associated with the player picked selection and determines if each of the plurality of awards have been revealed. If each of the awards have been revealed, then the selection game ends. In one embodiment, the gaming device provides the player an additional award or value if the player's picked selections are each associated with a specific award of each set or pair of awards. For example, if the player's picked selections are each associated with the modified award of each set or pair of awards, then the player is provided an additional award or value. If each of the awards have not been revealed, then the gaming device enables the player to pick another one of the masked selections.

This embodiment of the selection game proceeds as described above (enabling the player to pick masked selections and revealing the picked masked selection and the award related to the masked selection) until either a terminator is revealed, each of the awards are revealed or a determined number of picked masked selections is made.

The selection game of the present invention provides a player with a new and exciting game that enables a player to weigh options and explore the consequences of selecting those options where the player may accumulate awards.

Additional features and advantages of the present invention are described in, and will be apparent from, the following Detailed Description of the Invention and the figures.

DETAILED DESCRIPTION OF THE INVENTION

Figure 1A:
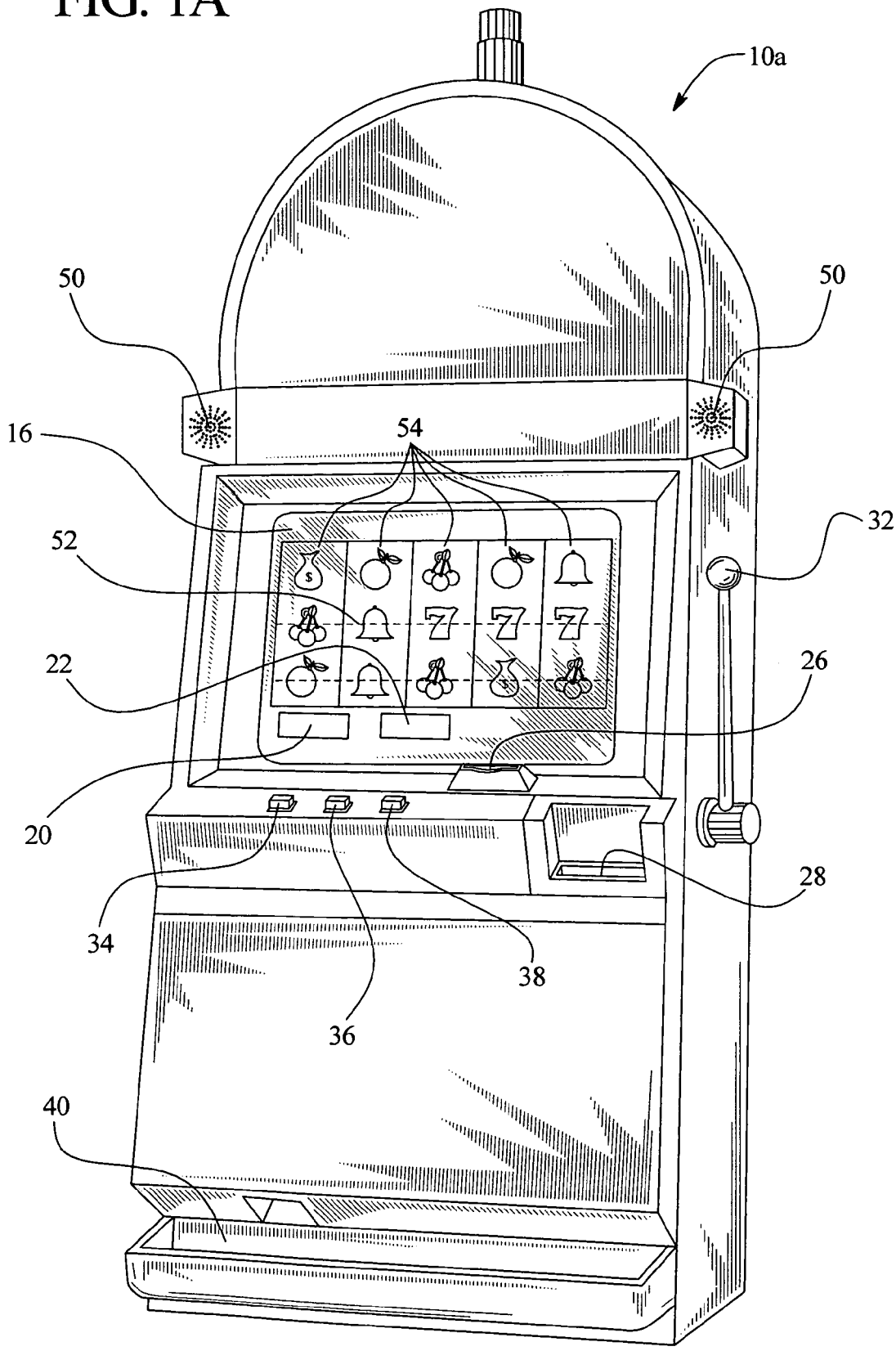
FIG. 1A is a front-side perspective view of one embodiment of the gaming device of the present invention.
Figure 1B:
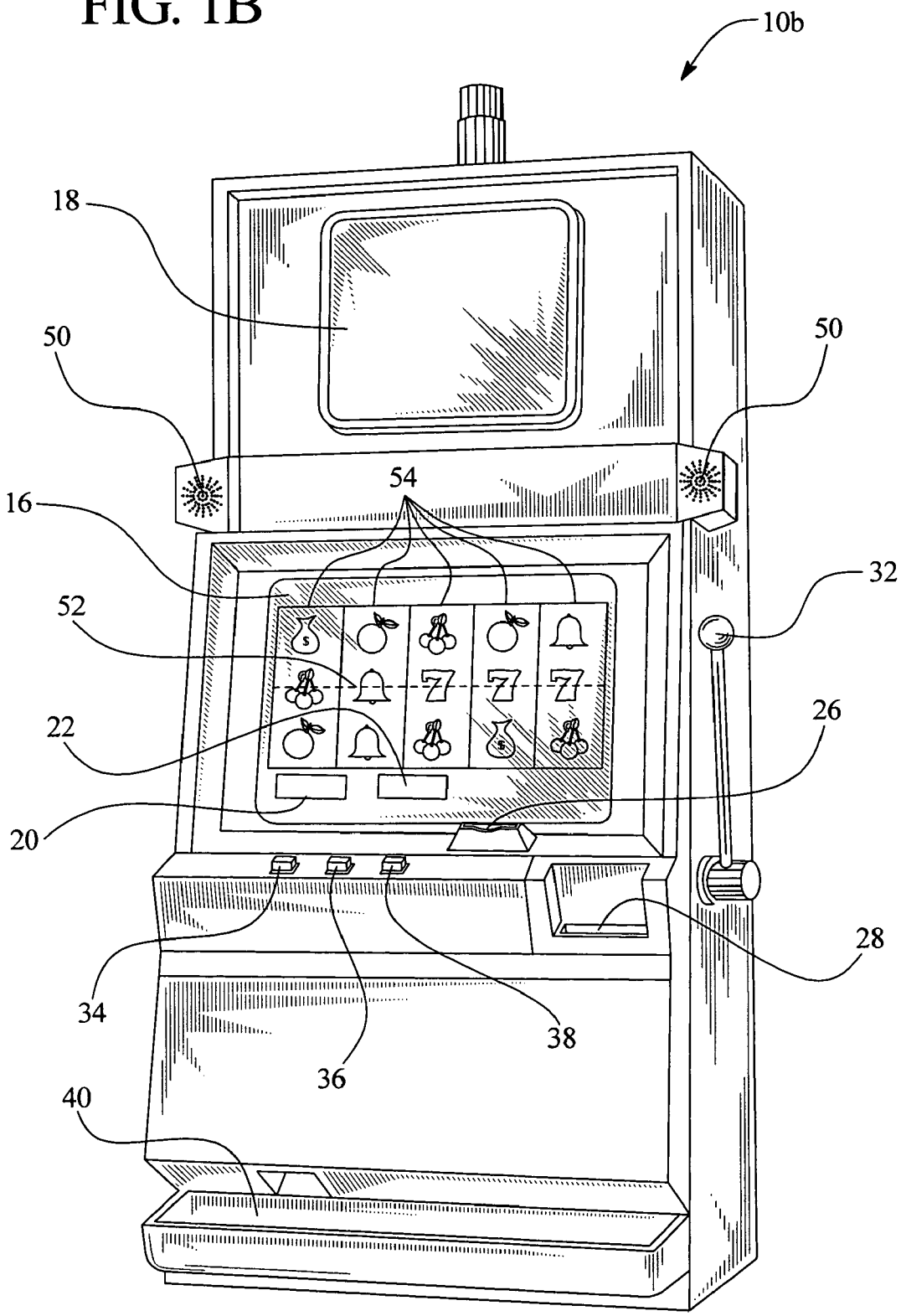
FIG. 1B is a front-side perspective view of another embodiment of the gaming device of the present invention.

Referring now to the drawings, two alternative embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10.

In one embodiment, as illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device can be constructed with varying cabinet and display configurations,.

Figure 2A:
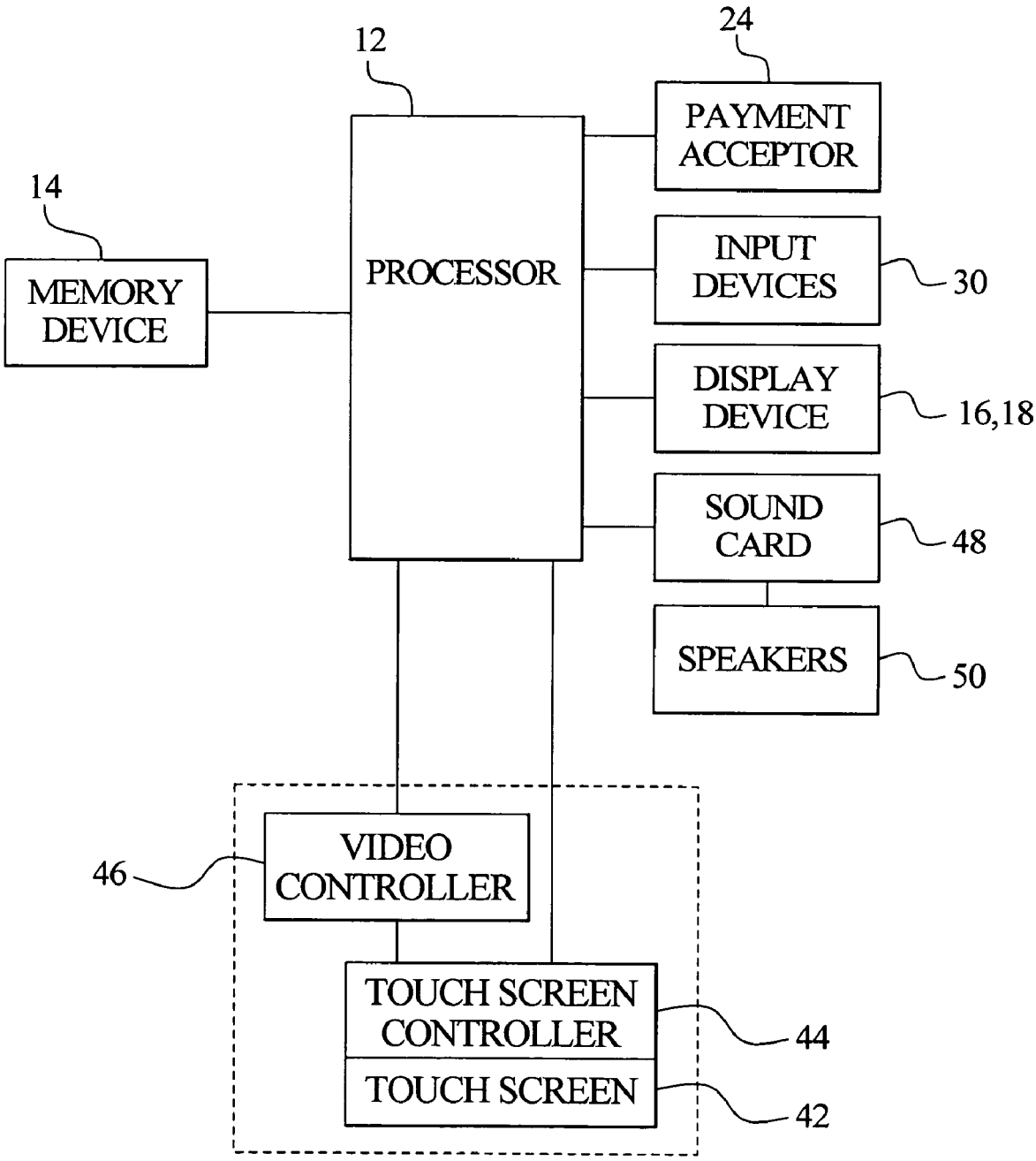
FIG. 2A is a schematic block diagram of the electronic configuration of one embodiment of the gaming device of the present invention.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or other operating data, information and applicable game rules that relate to the play of the gaming device. In another embodiment, the memory device includes random access memory (RAM). In one embodiment, the memory device includes read only memory (ROM). In a further embodiment, the memory device includes flash memory and/or EEPROM (electrically erasable programmable read only memory). Any other suitable magnetic, optical and/or semiconductor memory may be implemented in conjunction with the gaming device of the present invention.

In one embodiment, part or all of the program code and/or operating data described above can be stored in a detachable or removable memory device, including, but not limited to, a suitable cartridge, disk or CD ROM. A player can use such a removable memory device in a desktop, a laptop personal computer, a personal digital assistant (PDA) or other computerized platform. The processor and memory device may be collectively referred to herein as a "computer" or "controller."

In one embodiment, as discussed in more detail below, the gaming device randomly generates awards and/or other game outcomes based on probability data. That is, each award or other game outcome is associated with a probability and the gaming device generates the award or other game outcome to be provided to the player based on the associated probabilities. In this embodiment, since the gaming device generates outcomes randomly or based upon a probability calculation, there is no certainty that the gaming device will provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device removes the provided award or other game outcome from the predetermined set or pool. Once removed from the set or pool, the specific provided award or other game outcome cannot be provided to the player again. In this type of embodiment, the gaming device provides players with all of the available awards or other game outcomes over the course of the play cycle and guarantees a designated amount of actual wins and losses.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated with the primary game and/or information relating to the primary or secondary game. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered.

The display devices may include, without limitation, a monitor, a television display, a plasma display, a liquid crystal display (LCD), a display based on light emitting diodes (LED) or any other suitable electronic device or display mechanism. In one embodiment, as described in more detail below, the display device includes a touch-screen with an associated touch-screen controller. The display devices may be of any suitable configuration, such as a square, a rectangle or an elongated rectangle.

The display devices of the gaming device are configured to display at least one and preferably a plurality of games or other suitable images, symbols and indicia such as any visual representation or exhibition of the movement of objects such as mechanical, virtual or video reels and wheels, dynamic lighting, video images and images of people, characters, places, things and faces of cards, tournament advertisements, promotions and the like.

In one alternative embodiment, the symbols, images and indicia displayed on or by the display device may be in mechanical form. That is, the display device may include any suitable electromechanical device which preferable moves one or more mechanical objects, such as one or more mechanical rotatable wheels, reels or dice, configured to display at least one and preferably a plurality of games or other suitable images, symbols or indicia.

As illustrated in FIG. 2A, in one embodiment, the gaming device includes at least one payment acceptor 24 in communication with the processor. As seen in FIGS. 1A and 1B, the payment acceptor may include a coin slot 26 and a payment, note or bill acceptor 28, where the player inserts money, coins or tokens. The player can place coins in the coin slot or paper money, ticket or voucher into the payment, note or bill acceptor. In other embodiments, devices such as readers or validators for credit cards, debit cards, data cards or credit slips could be used for accepting payment. In one embodiment, a player may insert an identification card into a card reader of the gaming device. In one embodiment, the identification card is a smart card having a programmed microchip or a magnetic strip coded with a player's identification, credit totals and other relevant information. In one embodiment, money may be transferred to a gaming device through electronic funds transfer. When a player funds the gaming device, the processor determines the amount of funds entered and the corresponding amount is shown on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is read by the processor. In one embodiment, after appropriate funding of the gaming device, the input device is a game activation device, such as a pull arm 32 or a play button 34 which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, as shown in FIGS. 1A and 1B, one input device is a bet one button 36. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game associated with the gaming device.

In one embodiment, one input device is a cash out button 38. The player may push the cash out button and cash out to receive a cash payment or other suitable form of payment corresponding to the number of remaining credits. In one embodiment, when the player cashes out, the player receives the coins or tokens in a coin payout tray 40. In one embodiment, when the player cashes out, the player may receive other payout mechanisms such as tickets or credit slips which are redeemable by a cashier or funded to the player's electronically recordable identification card.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the,touch-screen at the appropriate places.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera, in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display device may be configured to display the image acquired by the camera as well as display the visible manifestation of the game in split screen or picture-in-picture fashion. For example, the camera may acquire an image of the player and that image can be incorporated into the primary and/or secondary game as a game image, symbol or indicia.

The gaming device can incorporate any suitable wagering primary or base game. The gaming machine or device of the present invention may include some or all of the features of conventional gaming machines or devices. The primary or base game may comprise any suitable reel-type game, card game, number game or other game of chance susceptible to representation in an electronic or electromechanical form which produces a random outcome based on probability data upon activation of the game from a wager made by the player. That is, different primary wagering games, such as video poker games, video blackjack games, video keno, video bingo or any other suitable primary or base game may be implemented into the present invention.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device displays at least one reel and preferably a plurality of reels 54, such as three to five reels, in either electromechanical form with mechanical rotating reels or in video form with simulated reels and movement thereof. In one embodiment, an electromechanical slot machine includes a plurality of adjacent, rotatable wheels which may be combined and operably coupled with an electronic display of any suitable type. In another embodiment, if the reels are in video form, the plurality of simulated video reels are displayed on one or more of the display devices as described above. Each reel displays a plurality of indicia such as bells, hearts, fruits, numbers, letters, bars or other images which preferably correspond to a theme associated with the gaming device. In this embodiment, the gaming device awards prizes when the reels of the primary game stop spinning if specified types and/or configurations of indicia or symbols occur on an active pay line or otherwise occur in a winning combination or pattern.

In one embodiment, a base or primary game may be a poker game wherein the gaming device enables the player to play a conventional game of video poker and initially deals five cards, all face up, from a virtual deck of fifty-two cards. Cards may be dealt as in a traditional game of cards or in the case of the gaming device, the cards may be randomly selected from a predetermined number of cards. If the player wishes to draw, the player selects the cards to hold by using one or more input devices, such as pressing related hold buttons or touching a corresponding area on a touch-screen. After the player presses the deal button, the processor of the gaming device removes the unwanted or discarded cards from the display and deals replacement cards from the remaining cards in the deck. This results in a final five-card hand. The processor of the gaming device compares the final five-card hand to a payout table which utilizes conventional poker hand rankings to determine the winning hands. Award based on a winning hand and the credits wagered is provided to the player.

In another embodiment, the base or primary game may be a multi-hand version of video poker. In this embodiment, the player is dealt at least two hands of cards. In one such embodiment, the cards in all of the dealt hands are the same cards. In one embodiment each hand of cards is associated with its own deck of cards. The player chooses the cards to hold in a primary hand. The held cards in the primary hand are also held in the other hands of cards. The remaining non-held cards are removed from each displayed hand and replaced with randomly dealt cards. Since the replacement cards are randomly dealt independently for each hand, the replacement cards will usually be different for each hand. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one and preferably a plurality of the selectable indicia or numbers by using an input device or by using the touch-screen. The gaming device then displays a series of drawn numbers to determine an amount of matches, if any, between the player's selected numbers and the gaming device's drawn numbers. The player is provided an award, if any, based on the amount of determined matches.

In one embodiment, in addition to winning credits in a base or primary game, the gaming device may also give players the opportunity to win credits in a bonus or secondary game or bonus or secondary round. The bonus or secondary game enables the player to obtain a bonus prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game.

In one embodiment, the bonus or secondary game may be any type of suitable game, either similar to or completely different from the base or primary game. In one embodiment, the gaming device includes a program code which causes the processor to automatically begin a bonus round when the player has achieved a triggering event, a qualifying condition or other designated game event in the base or primary game. In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In another embodiment, the triggering event or qualifying condition may be triggered by exceeding a certain amount of game play (number of games, number of credits, amount of time), earning a specified number of points during game play or as a random award.

In one embodiment, once a player has qualified for a bonus game, the player may subsequently enhance their bonus game participation by returning to the base or primary game for continued play. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple bonus qualifying events in the primary game may result in an arithmetic or geometric increase in the number of bonus wagering credits awarded. In one embodiment, extra bonus wagering credits may be redeemed during the bonus game to extend play of the bonus game.

In one embodiment, no separate entry fee or buy in for a bonus game need be employed. That is, a player may not purchase an entry into a bonus game. The player must win or earn entry through play of the primary game, thereby encouraging play of the primary game. In another embodiment, qualification of the bonus or secondary game could be accomplished through a simple "buy in" by the player if, for example, the player has been unsuccessful at qualifying for the bonus game through other specified activities.

Figure 2B:
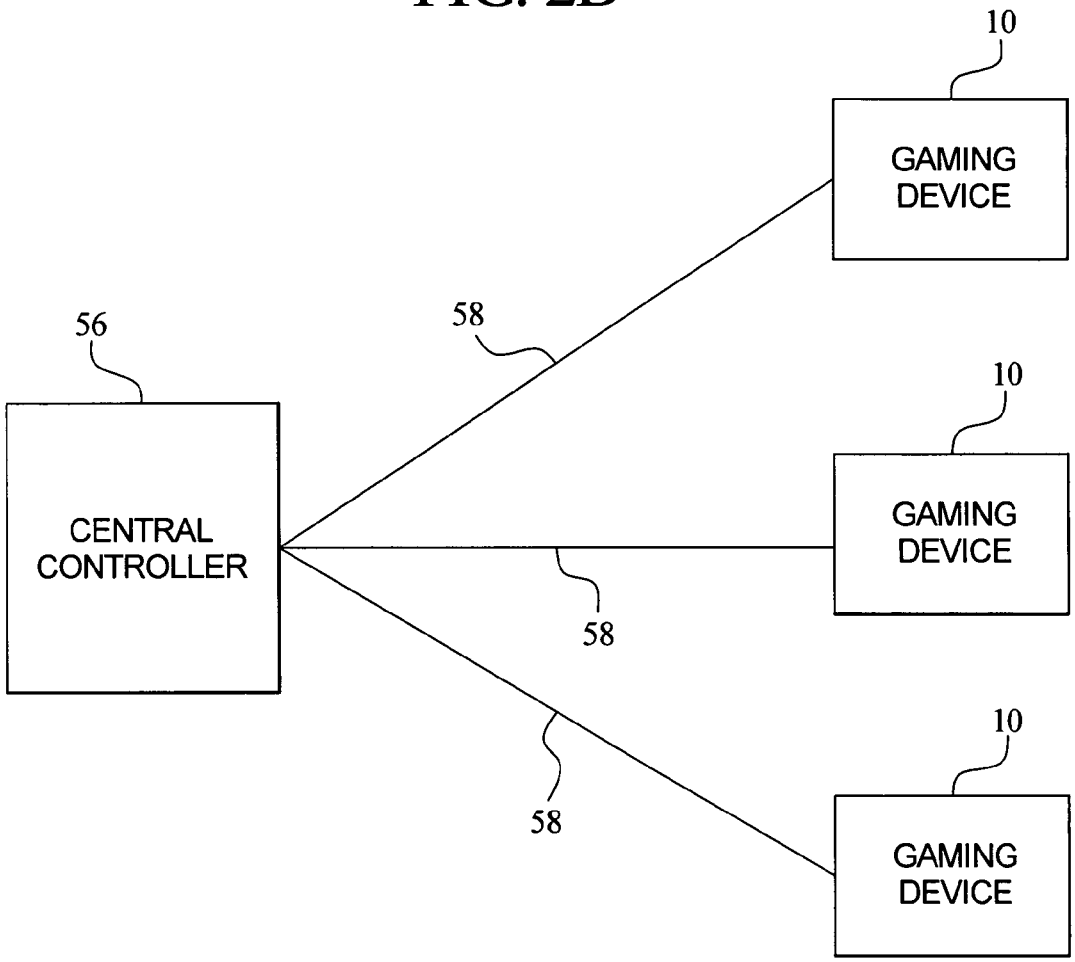
FIG. 2B is a schematic block diagram illustrating a plurality of gaming terminals in communication with a central controller.

In one embodiment, as illustrated in FIG. 2B, one or more of the gaming devices 10 of the present invention may be connected to a data network or a remote communication link 58 with some or all of the functions of each gaming device provided at a central location such as a central server or central controller 56. More specifically, the processor of each gaming device may be designed to facilitate transmission of signals between the individual gaming device and the central server or controller.

In one embodiment, the game outcome provided to the player is determined by a central server or controller and provided to the player at the gaming device of the present invention. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such a free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and/or preventing cheating or electronic or other errors, reducing or eliminating win-loss volatility and the like.

In another embodiment, one or more of the gaming devices of the present invention are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or an on-line accounting and gaming information system operably coupled to the central server or controller. The accounting and gaming information system of this embodiment includes a player database for storing player profiles, a player tracking module for tracking players and a credit system for providing automated casino transactions.

A plurality of the gaming devices of the present invention are capable of being connected to a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system of the present invention may be substantially identical to the LAN gaming system described above, although the number of gaming devices in each system may vary relative to each other.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server or webserver) through a conventional phone or other data transmission line, digital signal line (DSL), T-1 line, coaxial cable, fiber optic cable, wireless gateway or other suitable connection. In this embodiment, players may access an internet game page from any location where an internet connection and computer, or other internet facilitator are available. The expansion in the number of computers and number and speed of internet connections in recent years increases opportunities for players to play from an ever-increasing number of remote sites. It should be appreciated that enhanced bandwidth of digital wireless communications may render such technology suitable for some or all communications according to the present invention, particularly if such communications are encrypted. Higher data transmission speeds may be useful for enhancing the sophistication and response of the display and interaction with the player.

In another embodiment, a plurality of gaming devices at one or more gaming sites may be networked to a central server in a progressive configuration, as known in the art, wherein a portion of each wager to initiate a base or primary game may be allocated to bonus or secondary event awards. In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state.

In one embodiment, the host site computer is maintained for the overall operation and control of the system. In this embodiment, a host site computer oversees the entire progressive gaming system and is the master for computing all progressive jackpots. All participating gaming sites report to, and receive information from, the host site computer. Each central server computer is responsible for all data communication between the gaming device hardware and software and the host site computer.

Selection Game

Referring now to FIGS. 3A to 3G, in one embodiment of the present invention, the gaming device includes a screen or display 100 which enables a player to make selections to obtain an award. The gaming device indicates or provides a plurality of selections 102, 104, 106, 108, 110, 112, 114, 116, 118, 120, 122 and 124.

In one embodiment of the present invention, the gaming device includes a plurality of awards or values. In one embodiment, the awards or values are randomly determined each time the selection game is initiated. In another embodiment, the awards or values are selected from a range of awards or values. In an alternative embodiment, the awards or values are selected from one or more predetermined pools of awards or values. In another embodiment, the selected awards or values are determined based on the player's wager, an occurrence in the primary wagering game or the triggering event that initiated the selection game. In another embodiment, each award or value is associated with a probability and the gaming device selects each award or value based on the associated probabilities. In one embodiment, a plurality and preferably each award or value is different. In another embodiment, a plurality of the awards or values are the same. In another embodiment, the final outcome is determined and the awards are determined based on this final outcome.

The gaming device also includes a plurality of modifiers. In one embodiment, each modifier is different. In another embodiment, a plurality of the modifiers are the same. In one embodiment, the modifiers are randomly determined each time the selection game is initiated. In another embodiment, the modifiers are selected from a range of modifiers. In an alternative embodiment, the modifiers are selected from one or more predetermined pools of modifiers. In another embodiment, the modifiers are selected based on the player's wager, an occurrence in the primary wagering game or the triggering event that initiated the selection game. In another embodiment, each modifier is associated with a probability and the gaming device selects each modifier based on the associated probabilities.

In the illustrated embodiment, the gaming device also includes at least one terminator. In another embodiment, the gaming device includes a plurality of terminators.

Figure 3A:
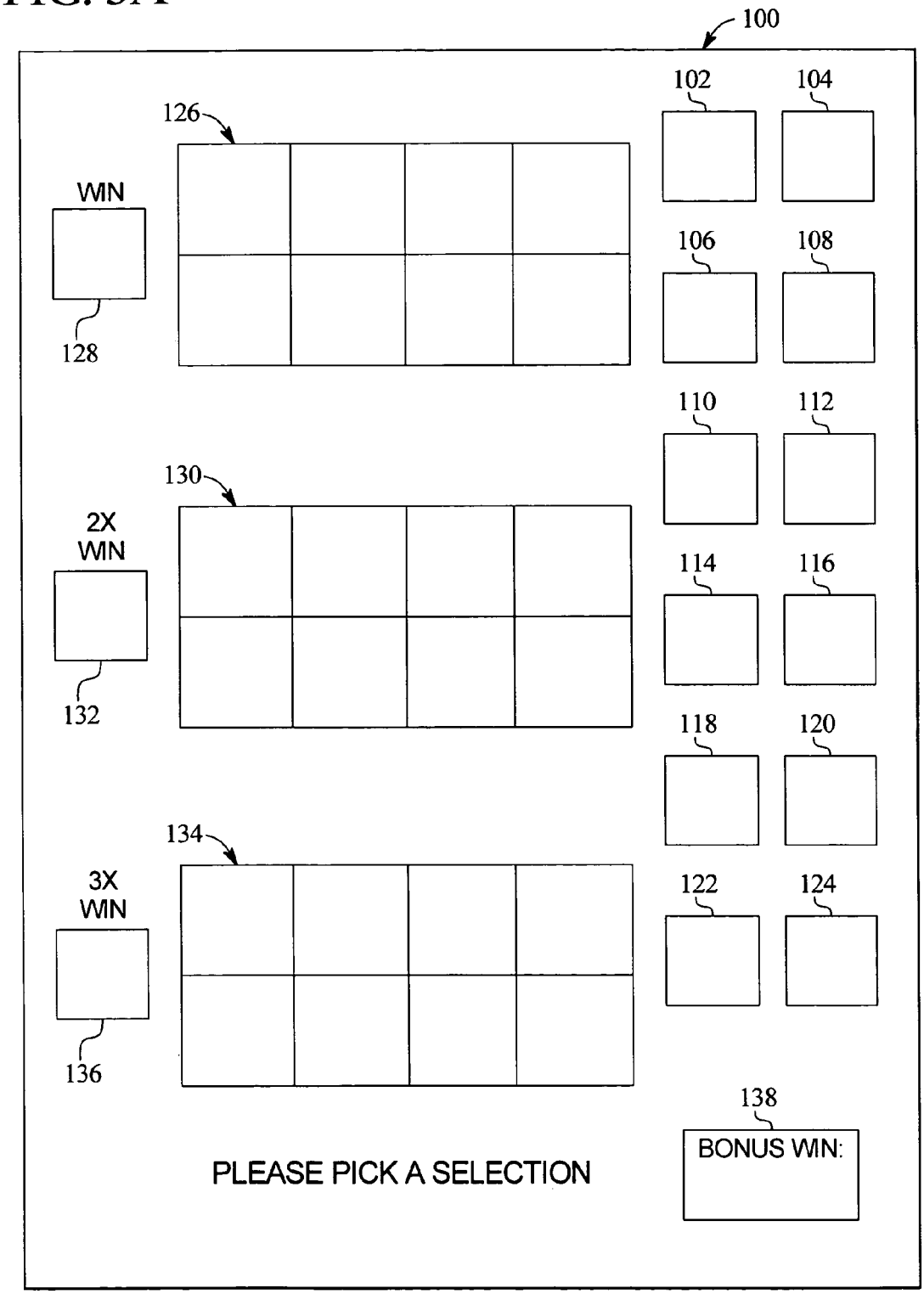
FIGS. 3A, 3B, 3C, 3D, 3E, 3F and 3G are front elevational views of one embodiment of the present invention illustrating a player provided an award based on a plurality of picked values and activated modifiers.

In one embodiment, the gaming device displays or indicates a plurality of groups, boards or levels that are each associated with one of the plurality of modifiers. As seen in FIG. 3A, the gaming device includes a group, board or level 126 associated with a 1× modifier, a group, board or level 130 associated with a 2× modifier and a group, board or level 134 associated with a 3× modifier. In one embodiment, each group, board or level includes a plurality of spots or positions that are each associated with one of the plurality of awards or values. In this embodiment, as described in more detail below, when a modifier is activated, the group, board or level associated with the activated modifier is also activated. That is, each modifier functions as a group, board or level activator. Once activated, in one embodiment, each group, board or level will display any revealed awards at the same position on each of the activated groups, boards or levels. Each group, board or level is also associated with an award counter or display 128, 132 and 136 that displays the modified award amounts that are based on each group's associated activated modifier. The gaming device also includes a bonus win counter or display 138 that displays the total amount of awards or values provided to the player.

In one embodiment of the present invention, upon the initiation of the selection game, the gaming device selects at least one of the plurality of modifiers to activate. As seen by highlighted group 126 in FIG. 3B, the gaming device selected and activated the 1× modifier. The remaining inactive modifiers (in this case, the 2× modifier and the 3× modifier) are each associated with one of the plurality of selections. Moreover, each of the plurality of awards and each of the terminators are associated with one of the plurality of selections. Each selection is preferably masked and thus the award, terminator or modifier associated with each selection is not initially revealed or displayed to the player.

In one embodiment, the gaming device selects and activates a predetermined modifier, such as the lowest available modifier. In another embodiment, the gaming device randomly selects which modifier to activate based on the probabilities associated with each of the modifiers. In another embodiment, the activated modifier is determined based on the player's wager, an occurrence in the primary wagering game or the triggering event that initiated the selection game. In another embodiment, the first picked selection determines which modifier is initially activated.

In one embodiment, the award, terminator or modifier associated with each selection is randomly determined each time the selection game is triggered. In this embodiment, after an award, terminator or modifier is associated with a selection, that association remains fixed for the duration of the selection game. In an alternative embodiment, the award, terminator or modifier associated with each selection is randomly determined prior to each time the player is allowed to pick a selection.

As seen in FIG. 3A, the gaming device enables the player to pick one of the plurality of selections. Appropriate messages such as "PLEASE PICK A SELECTION" are provided to the player visually or through suitable audio or audiovisual displays.

In one embodiment, the award, terminator or modifier associated with the picked selection is revealed to the player. In an alternative embodiment, the award, terminator or modifier associated with the picked selection is not revealed to the player. In another embodiment, the gaming device randomly selects which award, modifier or terminator to reveal to the player. In this embodiment, since the player has no control over which award, modifier or terminator is picked, the awards, modifiers and terminators are not associated with selections. Rather, the gaming device selects and reveals each award, modifier or terminator on a display device, such as a wheel or reel. In another embodiment, each award, modifier and terminator is associated with a probability of being selected. In this embodiment, the gaming device selects each award, modifier or terminator based on the associated probabilities.

Figure 3B:
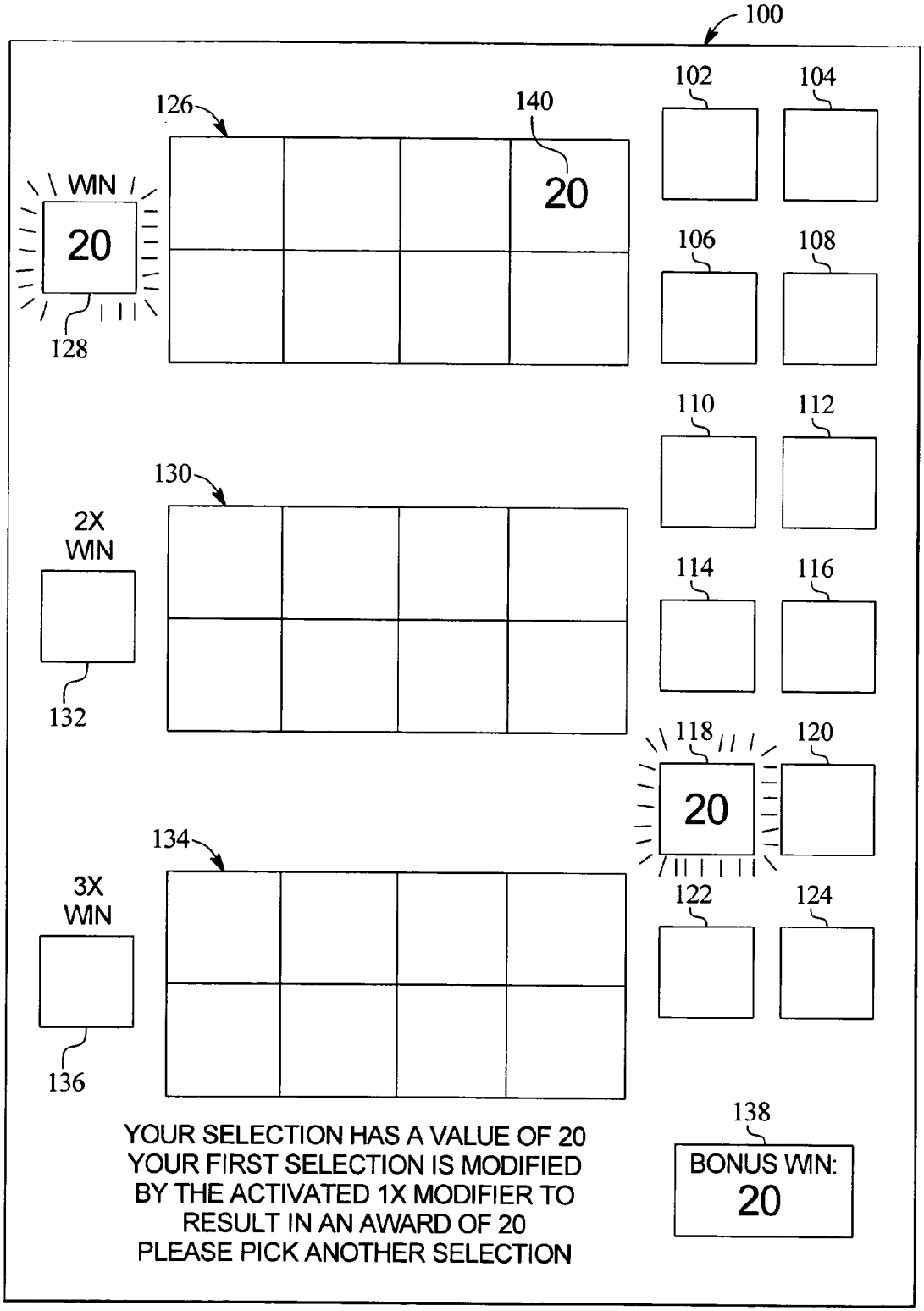

As illustrated in FIG. 3B, the player picked highlighted selection 118 which revealed an award of twenty. The revealed award is modified by each of the activated modifiers and each of the modified awards are accumulated for or provided to the player. In this case, the revealed award of twenty is modified or multiplied by the activated 1× modifier to form a modified award of twenty. The modified award is accumulated for or provided to the player. In this embodiment, the revealed award is displayed at the appropriate position 140 of the group, board or level 126 associated with the activated 1× modifier. The award counter associated with the activated modifier 128 displays the modified award and the bonus win counter 138 displays the amount of twenty which is the total amount of awards or values provided to the player. Appropriate messages such as "YOUR FIRST SELECTION HAS A VALUE OF 20," "YOUR FIRST SELECTION IS MODIFIED BY THE ACTIVATED 1× MODIFIER TO RESULT IN AN AWARD OF 20" and "PLEASE PICK ANOTHER SELECTION" are provided to the player visually or through suitable audio or audiovisual displays.

In an alternative embodiment, each activated modifier can perform any suitable mathematical function on the revealed award. In another embodiment, different modifiers may be associated with different mathematical functions. That is, one activated modifier may multiply the revealed award and the modifier and another activated modifier may combine the revealed award and the modifier.

It should be appreciated that if the player's first picked selection reveals a modifier, then that modifier is activated but the player will not be provided any award. That is, since there is no previously revealed award or value to modify, the activated modifier provides no immediate benefit and can only modify each of the subsequently revealed awards. It should be further appreciated that if the player's next picked selection is associated with a terminator, then the selection game will end without the player provided any awards based on any of the activated modifiers. In one embodiment, there is no intrinsic award or value associated with each activated modifier and in order to be provided a modified award, each activated modifier requires at least one revealed award or value to modify. In another embodiment, if a terminator is picked before any awards are provided to the player based on any activated modifiers, a consolation award or prize is provide to the player. In another embodiment, the picked terminator is associated with an award or prize which is provided to the player. In another embodiment, the gaming device provides the player a start or initial value for each activated modifier. In this embodiment, when each modifier is activated, the gaming device provides the player at least one award or value for the activated modifier to modify.

In another embodiment, the gaming device displays at least one available award or value and at least one available modifier to the player. This embodiment increases the player's excitement and enjoyment because the player can root or hope for a specific displayed award or modifier when they are picking a masked selections. In another embodiment, the gaming device displays to the player a plurality of the available awards or values and a plurality of the available modifiers. In another embodiment, the gaming device displays each of the available awards or values and each of the available modifiers to the player.

After providing the player an award for each activated modifier, the gaming device determines if all of the associated awards and all of the associated modifiers have been revealed. If all of the associated awards and all of the associated modifiers have been revealed, the selection game ends. In one embodiment, the player is provided an additional award or value for successfully revealing a designating number such as all of the associated awards and of the associated modifiers. If all of the associated awards and all of the associated modifiers have not been revealed, the gaming device enables the player to make a subsequent pick of the plurality of selections.

Figure 3C:
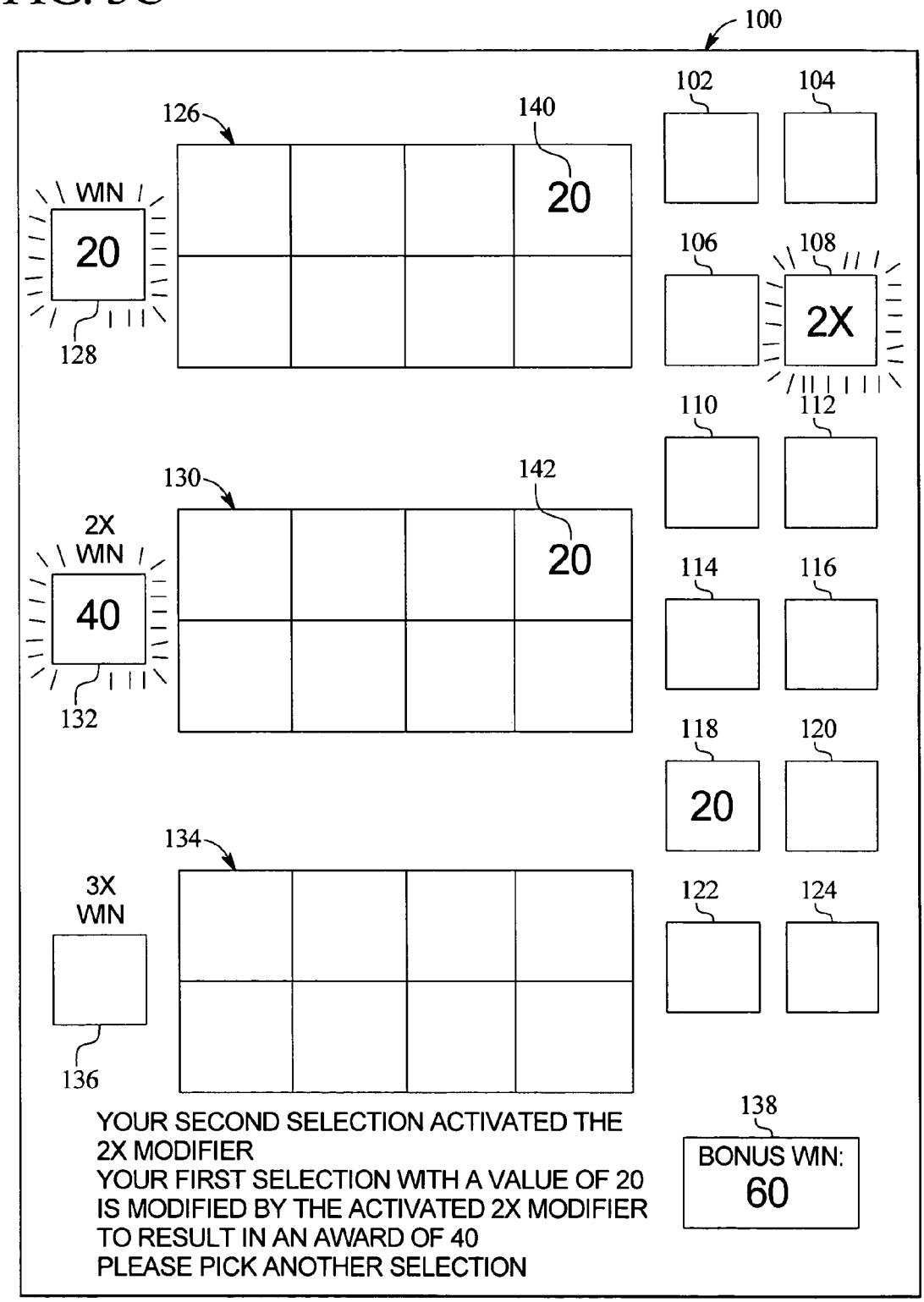

As illustrated in FIG. 3C, the player picked highlighted selection 108 which revealed an associated 2× modifier. The gaming device activates the revealed 2× modifier and retroactively applies the activated 2× modifier to each of the previously revealed awards or values. That is, each activated modifier will modify each of the revealed awards regardless of the order in which each modifier is activated or the order in which each award is revealed. In this case, the gaming device modifies the previously revealed award of twenty with the activated modifier of 2× to form a modified award of forty. In this embodiment, once a modifier is activated, then each of the previously revealed awards are displayed at the appropriate positions of the board associated with the activated modifier. As seen in FIG. 3C, the previously revealed award of twenty is displayed at the appropriate position 142 of the board 130 associated with the activated 2× modifier. The award counter associated with the activated modifier 132 displays the modified award and the bonus win counter 138 displays the amount of sixty which is the total amount of awards or values provided to the player. Appropriate messages such as "YOUR SECOND SELECTION ACTIVATED THE 2× MODIFIER," "YOUR FIRST SELECTION WITH A VALUE OF 20 IS MODIFIED BY THE ACTIVATED 2× MODIFIER TO RESULT IN AN AWARD OF 40" and "PLEASE PICK ANOTHER SELECTION" are provided to the player visually or through suitable audio or audiovisual displays.

In another embodiment, a revealed modifier may activate more than one modifier. For example, if the player picks a selection associated with a 3× modifier, then not only will the 3× modifier be activated, the 2× modifier will be activated as well. In one embodiment, a modifier may be related to or linked to at least one other modifier and if one modifier is activated, then the related or linked modifier is activated also. In another embodiment, the gaming device randomly selects, based on any associated probability, which other modifier to activate. In another embodiment, the gaming device enables the player to determine, such as through the playing of a side game, which modifier will also be activated. In another embodiment, if a modifier is activated, then each inactive lower modifier is activated as well. For example, if the player picks a selection associated with a 3× modifier, then not only will the 3× modifier be activated, the lower 1× modifier and the lower 2× modifier will also be activated. In these embodiments, as described above, the player will still be provided a separate award based on each activated modifier applied to each revealed award.

In another embodiment, each activated modifier is not retroactively applied to each previously revealed awards or values. Rather, in this embodiment, the activated modifier is only applied to each subsequently revealed award or value.

Figure 3D:
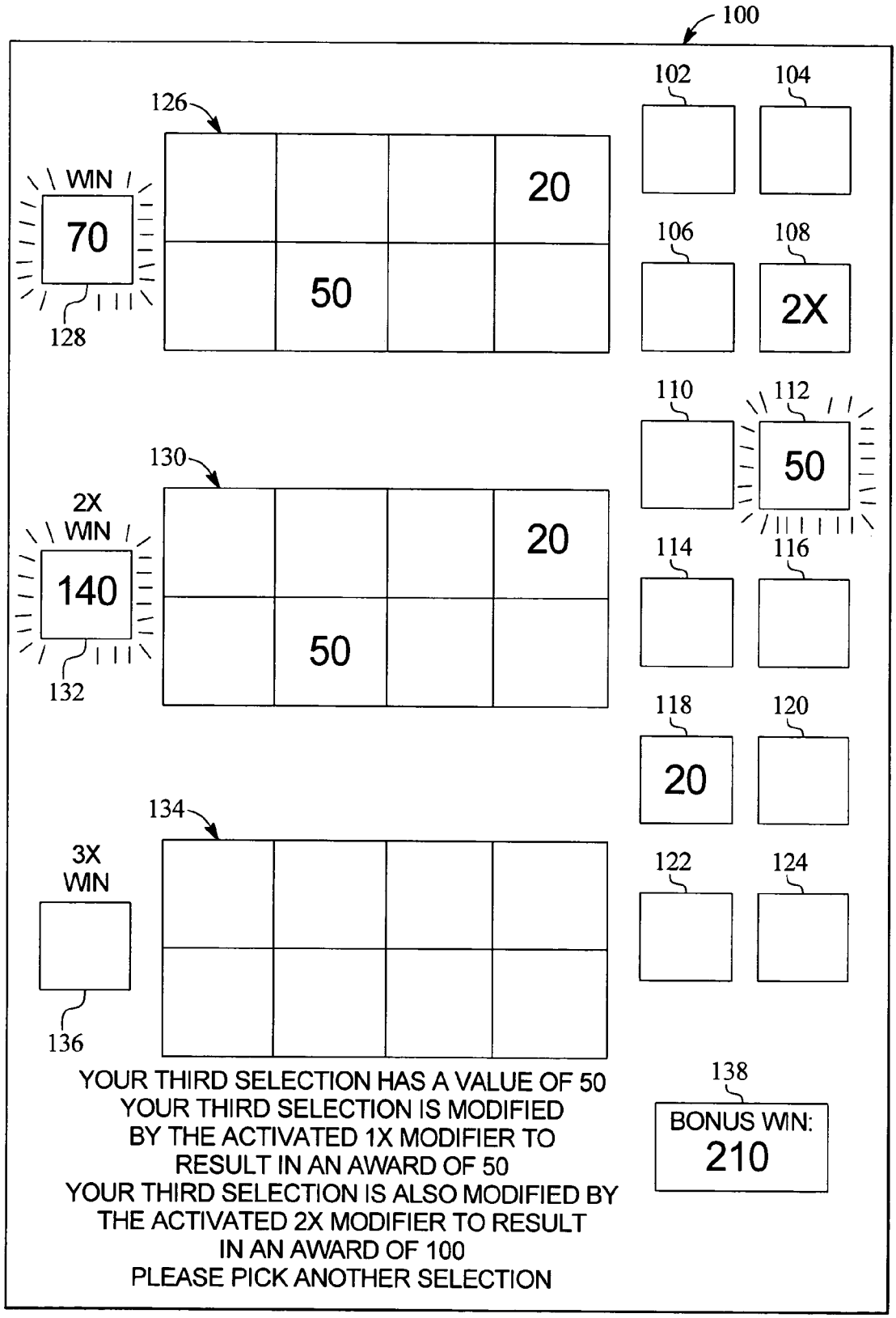

As described above, since not all of the associated awards and all of the associated modifiers have been revealed, the gaming device enables the player to make a subsequent pick of the plurality of selections. As illustrated in FIG. 3D, the player picked highlighted selection 112 which revealed an award of fifty. The revealed award is modified by each of the activated modifiers and each of the modified awards are accumulated for or provided to the player. In this case, the 1× modifier and the 2× modifier are both activated and the revealed award of fifty is displayed at the same position of the board 126 associated with the activated 1× modifier and the board 130 associated with the activated 2× modifier. The revealed award of fifty is modified by the activated 1× modifier to form a modified award of fifty. The award counter associated with the activated 1× modifier 128 displays the sum of the modified awards that are based on the activated 1× modifier, in this case seventy. Moreover, the revealed award of fifty is modified by the activated 2× modifier to form a modified award of one-hundred. The award counter associated with the activated 2× modifier 132 displays the sum of the modified awards that are based on the activated 2× modifier, in this case one-hundred forty. The bonus win counter 138 displays the amount of two-hundred ten which is the total amount of awards or values provided to the player. Appropriate messages such as ""YOUR THIRD SELECTION HAS A VALUE OF 50," "YOUR THIRD SELECTION IS MODIFIED BY THE ACTIVATED 1× MODIFIER TO RESULT IN AN AWARD OF 50," "YOUR THIRD SELECTION IS ALSO MODIFIED BY THE ACTIVATED 2× MODIFIER TO RESULT IN AN AWARD OF 100" and "PLEASE PICK ANOTHER SELECTION"" are provided to the player visually or through suitable audio or audiovisual displays.

Figure 3E:
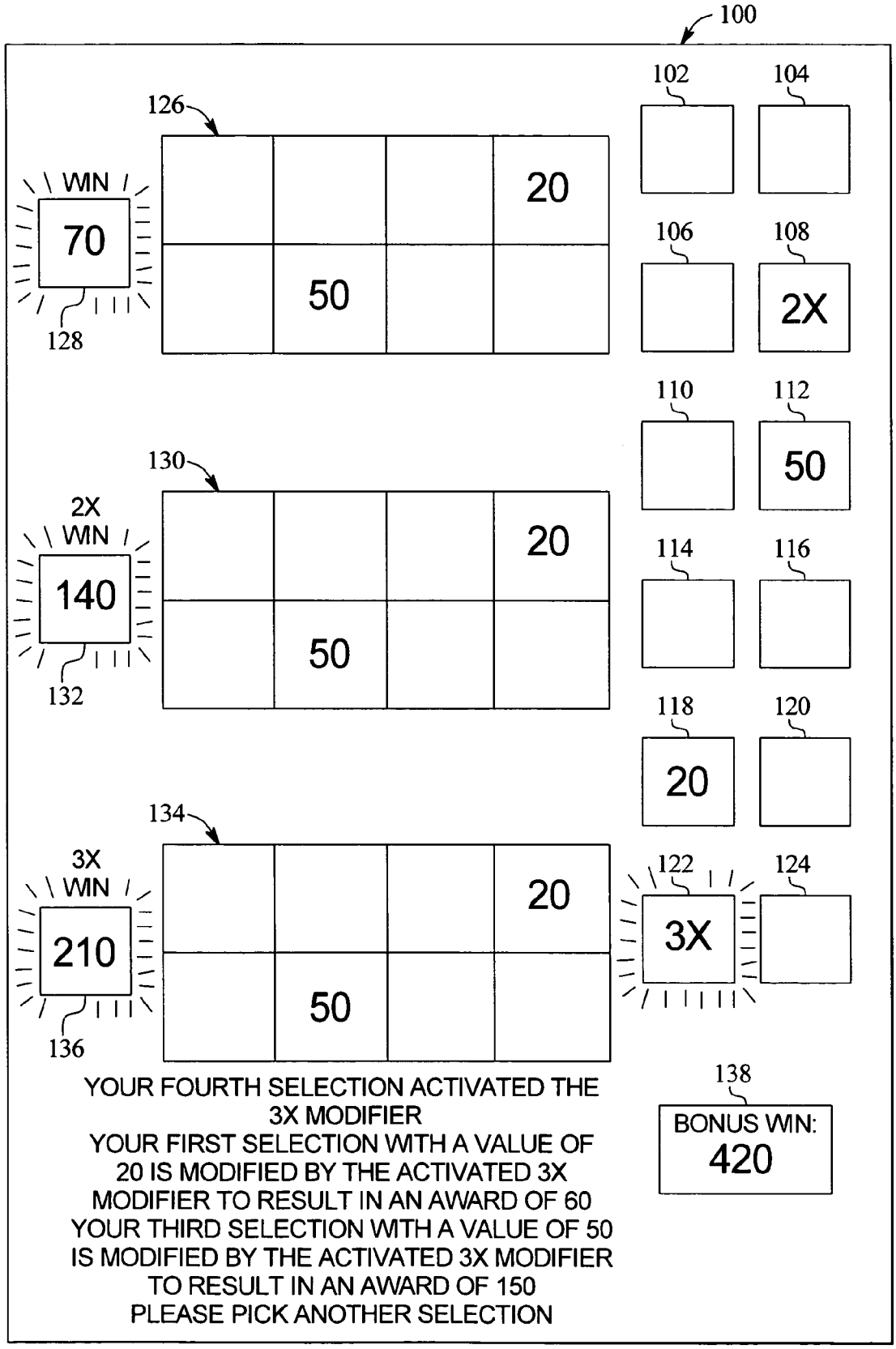

As illustrated in FIG. 3E, since not all of the associated awards and all of the associated modifiers have been revealed, the gaming device enables the player to make a subsequent pick of the plurality of selections. The player picked highlighted selection 122 which revealed an associated 3× modifier. The gaming device activates the revealed 3× modifier and retroactively applies the activated 3× modifier to each of the previously revealed awards or values. That is, each activated modifier will modify each of the revealed awards regardless of the order in which each modifier is activated or the order in which each award is revealed. In this case, the gaming device modifies the previously revealed award of twenty with the activated modifier of 3× to form a modified award of sixty. The gaming device also modifies the previously revealed award of fifty with the activated 3× modifier to form a modified award of one-hundred-fifty. In this embodiment, once a modifier is activated, then each of the previously revealed awards are displayed at the appropriate positions of the board associated with the activated modifier. As seen in FIG. 3E, the previously revealed awards of twenty and fifty are displayed at the appropriate positions of the board 134 associated with the activated 3× modifier. The award counter associated with the activated 3× modifier 136 displays the modified awards that are based on the activated 3× modifier and the bonus win counter 138 displays the amount of two-hundred-ten which is the total amount of awards or values provided to the player. Appropriate messages such as "YOUR FOURTH SELECTION ACTIVATED THE 3× MODIFIER," "YOUR FIRST SELECTION WITH A VALUE OF 20 IS MODIFIED BY THE ACTIVATED 3× MODIFIER TO RESULT IN AN AWARD OF 60 AND YOUR THIRD SELECTION WITH A VALUE OF 50 IS MODIFIED BY THE ACTIVATED 3× MODIFIER TO RESULT IN AN AWARD OF 150" and "PLEASE PICK ANOTHER SELECTION" are provided to the player visually or through suitable audio or audiovisual displays.

Figure 3F:
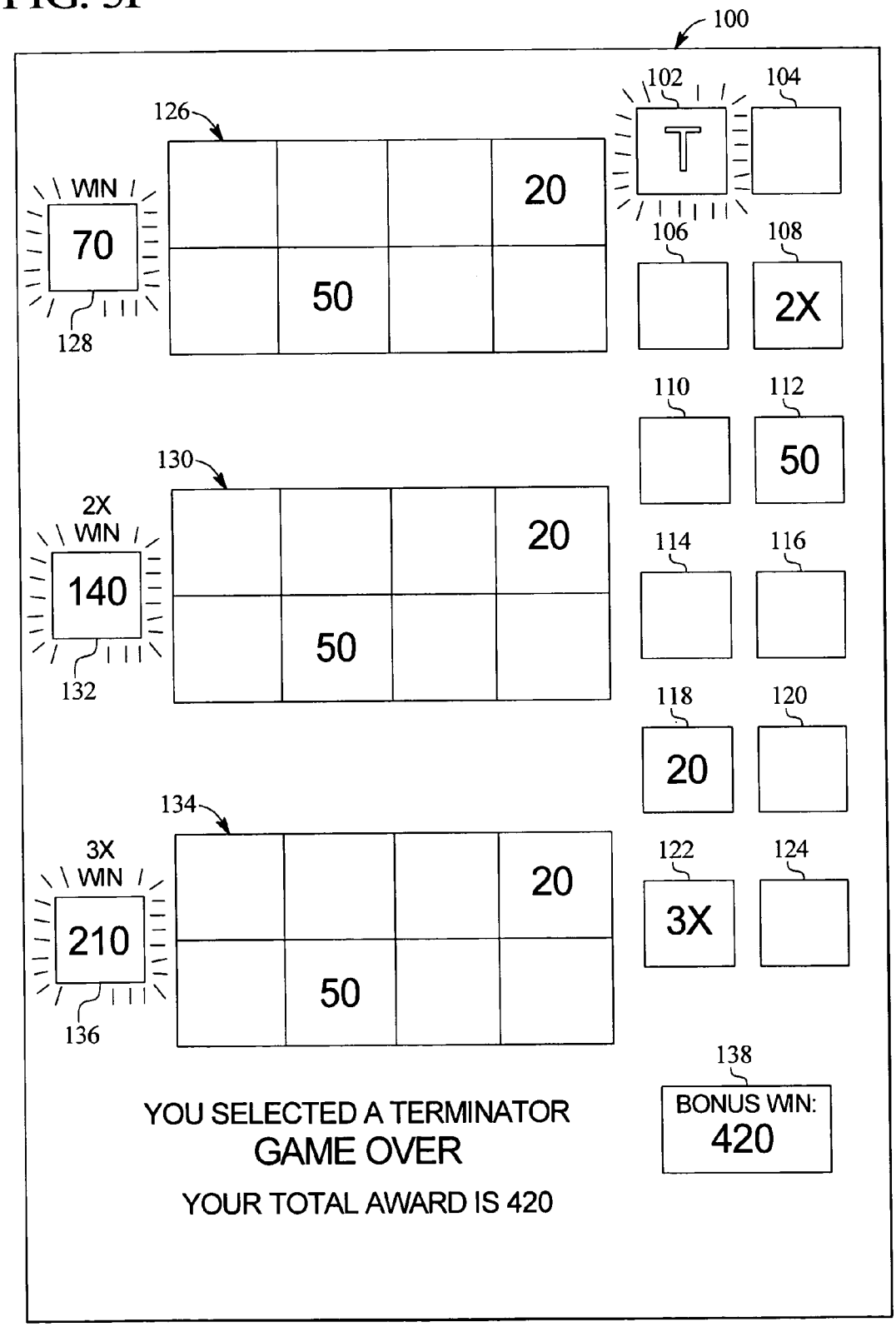

As described above, since not all of the associated awards and all of the associated modifiers have been revealed, the gaming device enables the player to make a subsequent pick of the plurality of selections. As illustrated in FIG. 3F, the player picked highlighted selection 102 which reveals an associated terminator. In alternative embodiment, if a player obtains the terminator, the gaming device will provide no award, provide the player a consolation award or select another award to provide the player. Accordingly, the selection game ends and appropriate messages such as "YOU SELECTED A TERMINATOR" "YOUR TOTAL AWARD IS 420" and "GAME OVER" are provided to the player visually or through suitable audio or audiovisual displays.

Figure 3G:
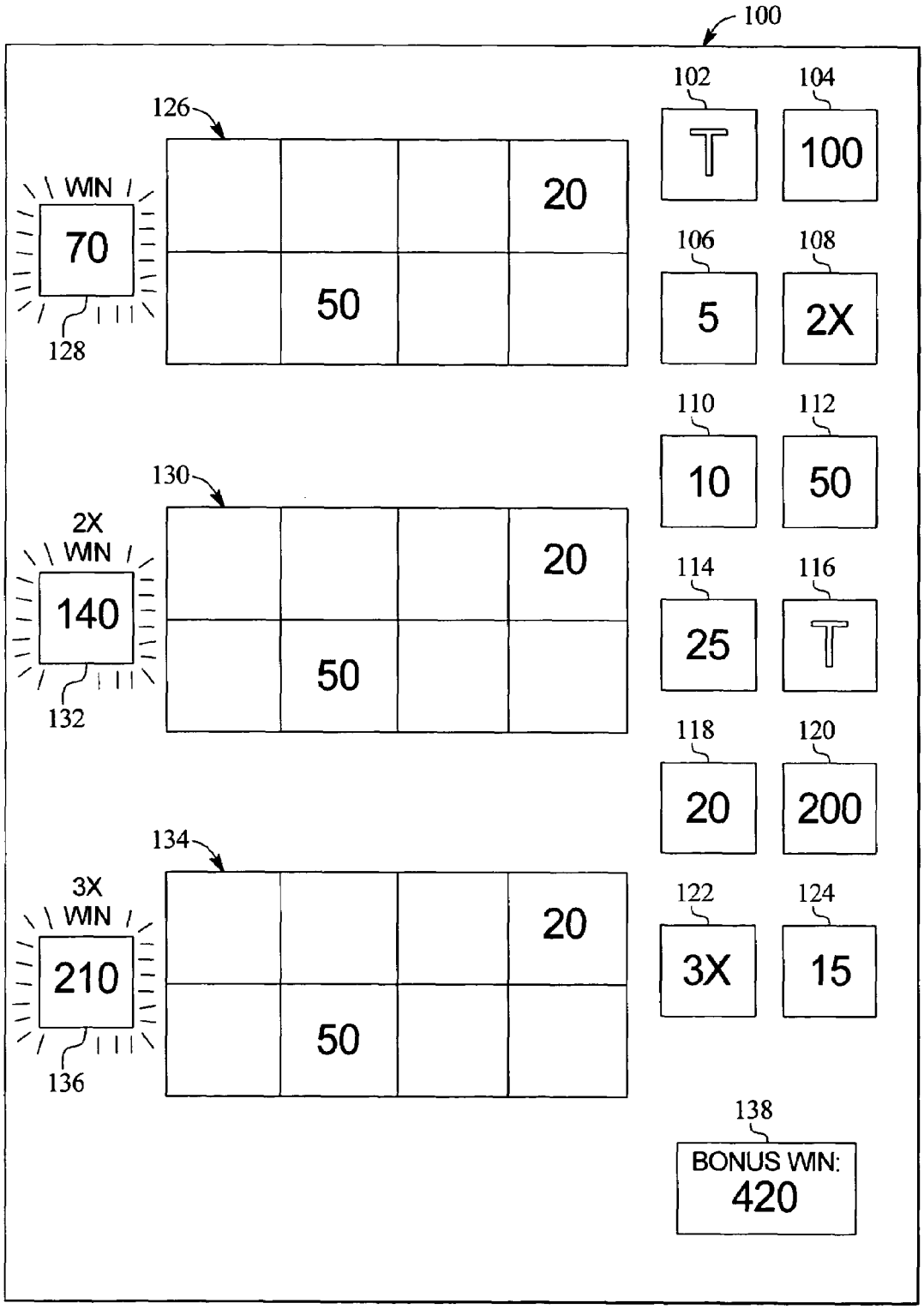

In one embodiment, as illustrated in FIG. 3G, at the conclusion of the selection game the gaming device reveals the award or modifier associated with each of the remaining non-picked selections. This embodiment increases the player's level of excitement because it shows the player the different awards and modifiers the player might had obtained if the player had picked different selections.

In another embodiment (not shown), each group, board or level is associated with a plurality of the same or duplicate awards and each group, board or level is associated with at least one non-duplicate award that is specific to that group, board or level. For example, the selection game may include the awards of one-thousand which is only associated with the level that is activated when the 3× modifier is activated. In this example, if the award of one-thousand is revealed, the award will only be displayed in association with the level associated with the 3× modifier. In one embodiment, for the player to be provided the non-duplicate award, the level associated with the revealed non-duplicate award must be activated. For example, if the award of one-thousand is revealed, but the 3× modifier is not activated (i.e., the level associated with the 3× modifier is not activated), then the player will not be provided any award based on the revealed award. In this embodiment, if the 3× modifier is subsequently activated, then as described above, the 3× modifier will be retroactively applied to the revealed award of one-thousand to form a modified award of three-thousand. However, if the selection game ends without the 3× modifier being activated, then, in this embodiment, the player will not obtain an award based on the revealed award of one-thousand. In another embodiment, the player will obtain the revealed non-duplicate award even if the level associated with the revealed non-duplicate is not activated.

In an alternative embodiment, the gaming device provides the player a number of picks of said selections to obtain awards and/or modifiers. In this embodiment, none of the selections are associated with terminators and the player is enabled to pick selections to reveal awards and/or modifiers until the player picks a selection for each provided number of picks. In another embodiment, the gaming device provides the player a number of picks and also associates at least one terminator with at least one of said selections. In this embodiment, the selection game ends when the player has picked a selection for each provided number of picks or when a terminator is revealed to be associated with one of the player's picked selections.

In an alternative embodiment of the present invention (not shown), at the initiation of the selection game, one of the plurality of modifiers is not activated and each of the modifiers are associated with one of the plurality selections. In this embodiment, if no modifier is activated, the award or value associated with each of the player's picked selections is accumulated for or provided to the player. If, during the course of the selection game, at least one modifier is activated, then the award or value associated with each of the player's picked selections is provided to the player along with the modified award or value which is based on each of the activated modifiers as described above. It should be appreciated that in this embodiment, each activated modifier will modify each subsequently revealed award as well as retroactively modify each previously revealed award. This embodiment proceeds as described above until either a terminator is revealed or all of the associated awards and all of the associated modifiers have been revealed.

Referring now to FIGS. 4A to 4D, in another embodiment of the present invention, the gaming device includes a plurality of symbols and a plurality of levels rather than a plurality of awards or values and a plurality of modifiers. In this embodiment, for each level, each symbol is associated with an award or value. As described in more detail below, rather than modifying each revealed award by each activated modifier, in this embodiment, the player is provided the award or value associated with each revealed symbol for each activated level.

Figure 4A:
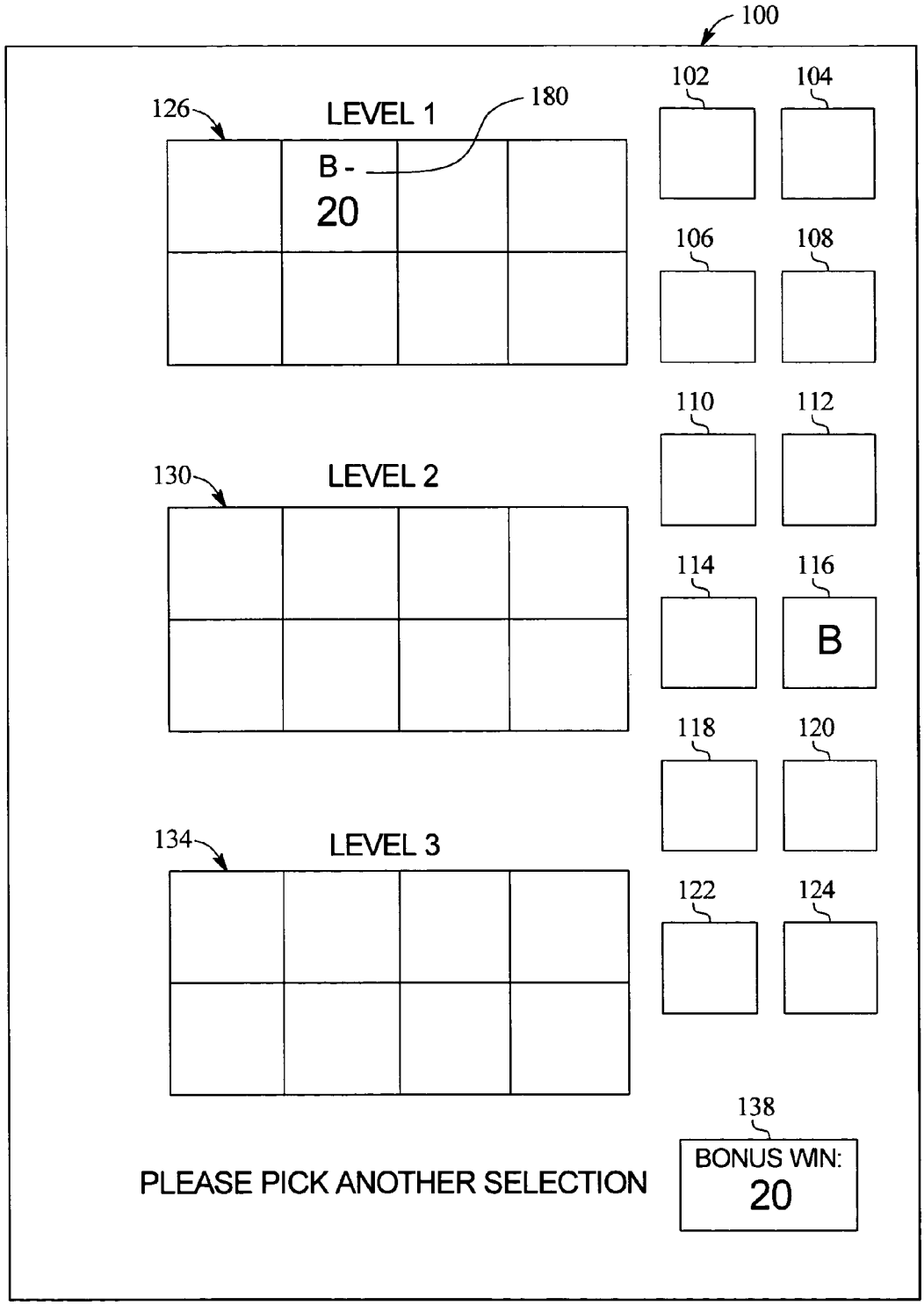
FIGS. 4A, 4B, 4C and 4D are front elevational views of an alternative embodiment of the present invention illustrating a player provided awards based on a plurality of picked symbols and activated levels.

As illustrated in FIG. 4A, the first level 126 has already been activated and the player has already picked selection 116 which revealed a "B" symbol. Moreover, the player has already obtained the award or value of twenty 180 associated with the "B" symbol for the activated first level and the player is about to pick another selection. Appropriate messages such as "PLEASE PICK ANOTHER SELECTION" are provided to the player visually or through suitable audio or audiovisual displays.

Figure 4B:
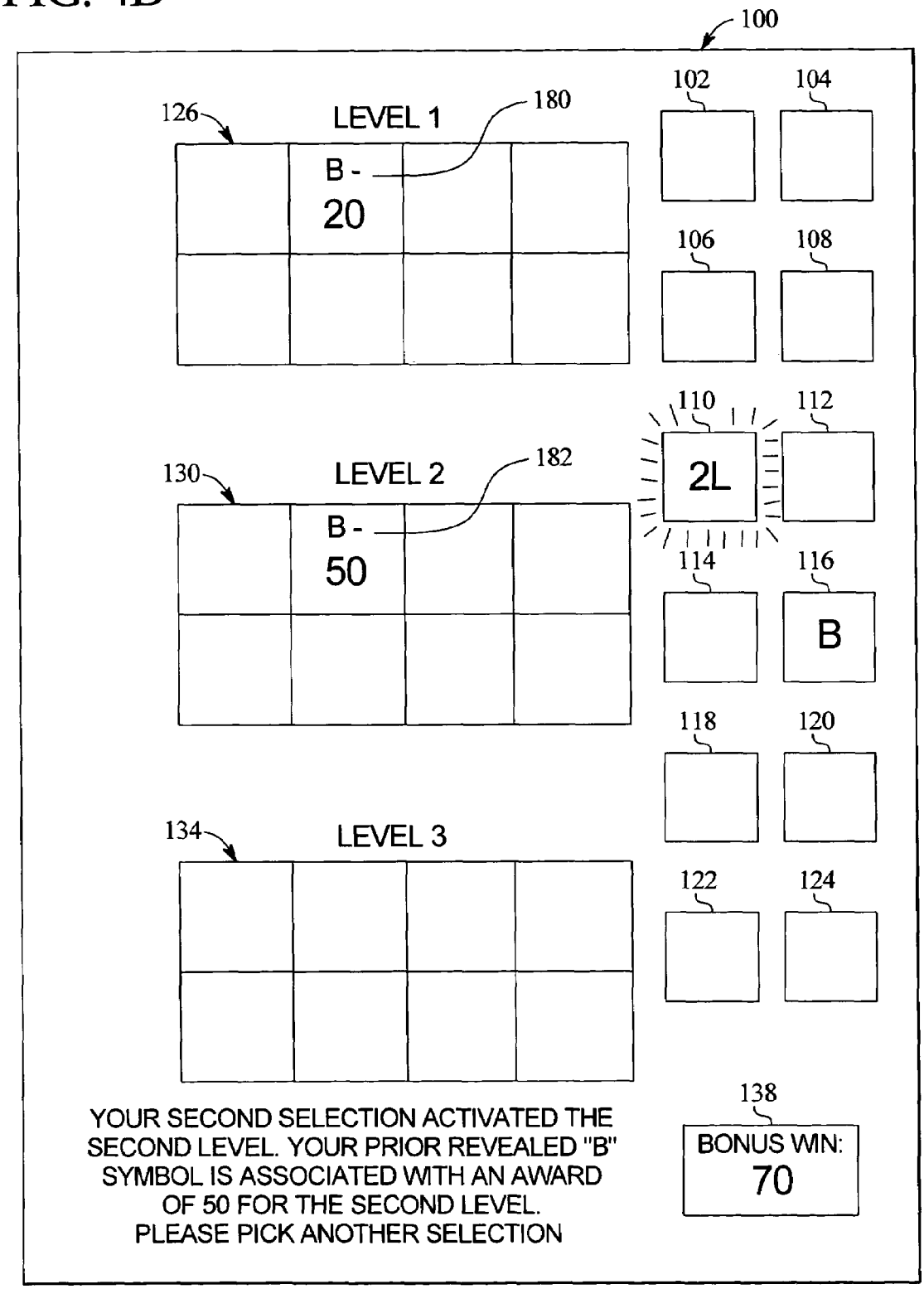

As illustrated in FIG. 4B, the player picked highlighted selection 110 which revealed to be associated with the "2L" symbol. Accordingly, the gaming device activates the second level. Once the second level is activated, the player is provided the award or value associated with each revealed symbol for the activated second level. Thus, the award of fifty 182 associated with the "B" symbol for the activated second level is provided to the player. The bonus win counter 138 displays the amount of seventy with is the total amount of awards or values provided to the player. Appropriate messages such as "YOUR SECOND SELECTION ACTIVATED THE SECOND LEVEL," "YOUR PRIOR REVEALED 'B' SYMBOL IS ASSOCIATED WITH AN AWARD OF 50 FOR THE SECOND LEVEL" and "PLEASE PICK ANOTHER SELECTION" are provided to the player visually or through suitable audio or audiovisual displays.

Figure 4C:
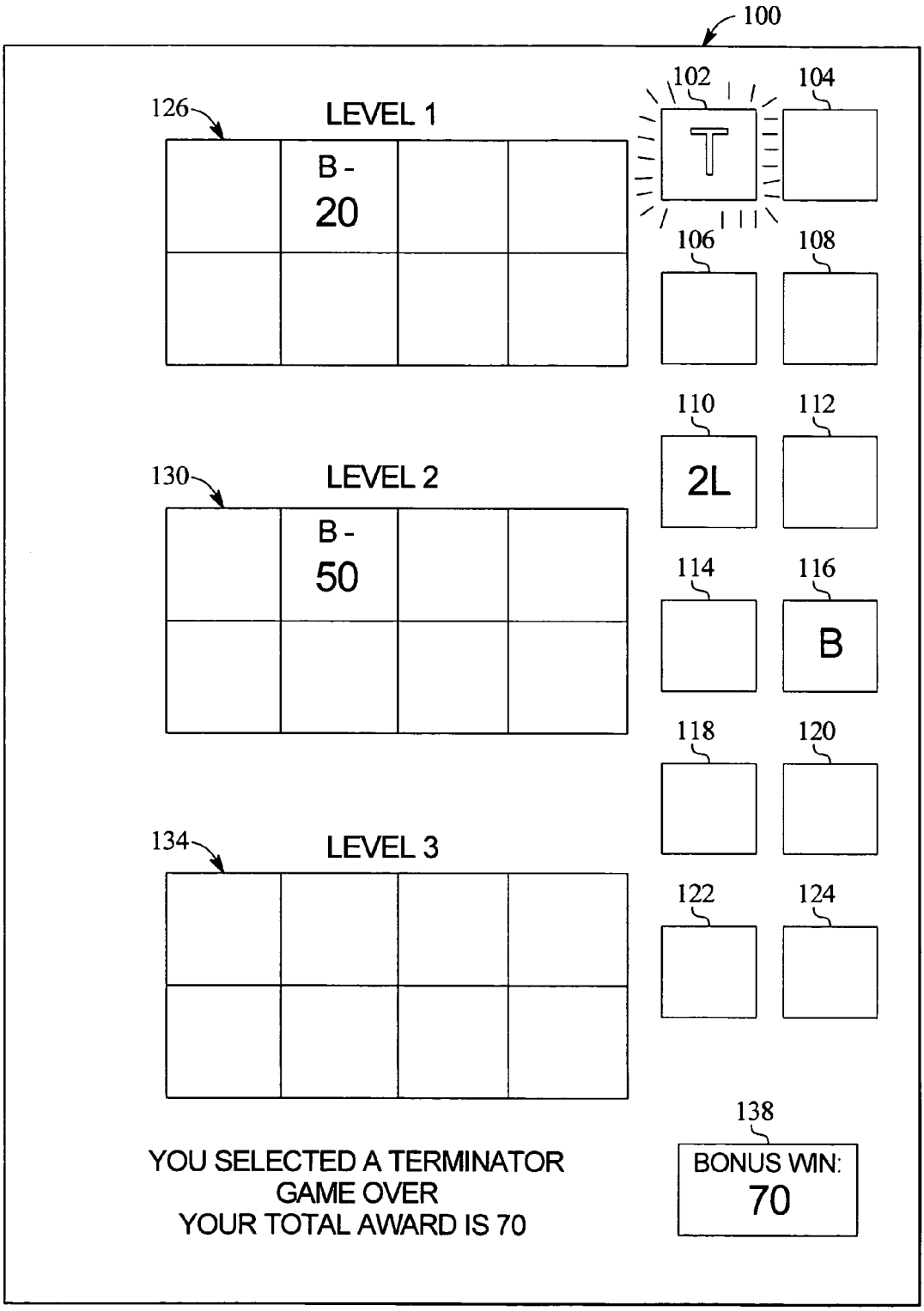

As described above, since not all of the associated symbols and all of the associated levels have been revealed, the gaming device enables the player to make a subsequent pick of the plurality of selections. As illustrated in FIG. 4C, the player picked highlighted selection 102 which reveals an associated terminator. If a player obtains the terminator, the gaming device will provide no award, provide the player a consolation award or select another award to provide the player. Accordingly, the selection game ends and appropriate messages such as "YOU SELECTED A TERMINATOR" "YOUR TOTAL AWARD IS 70" and "GAME OVER" are provided to the player visually or through suitable audio or audiovisual displays.

Figure 4D:
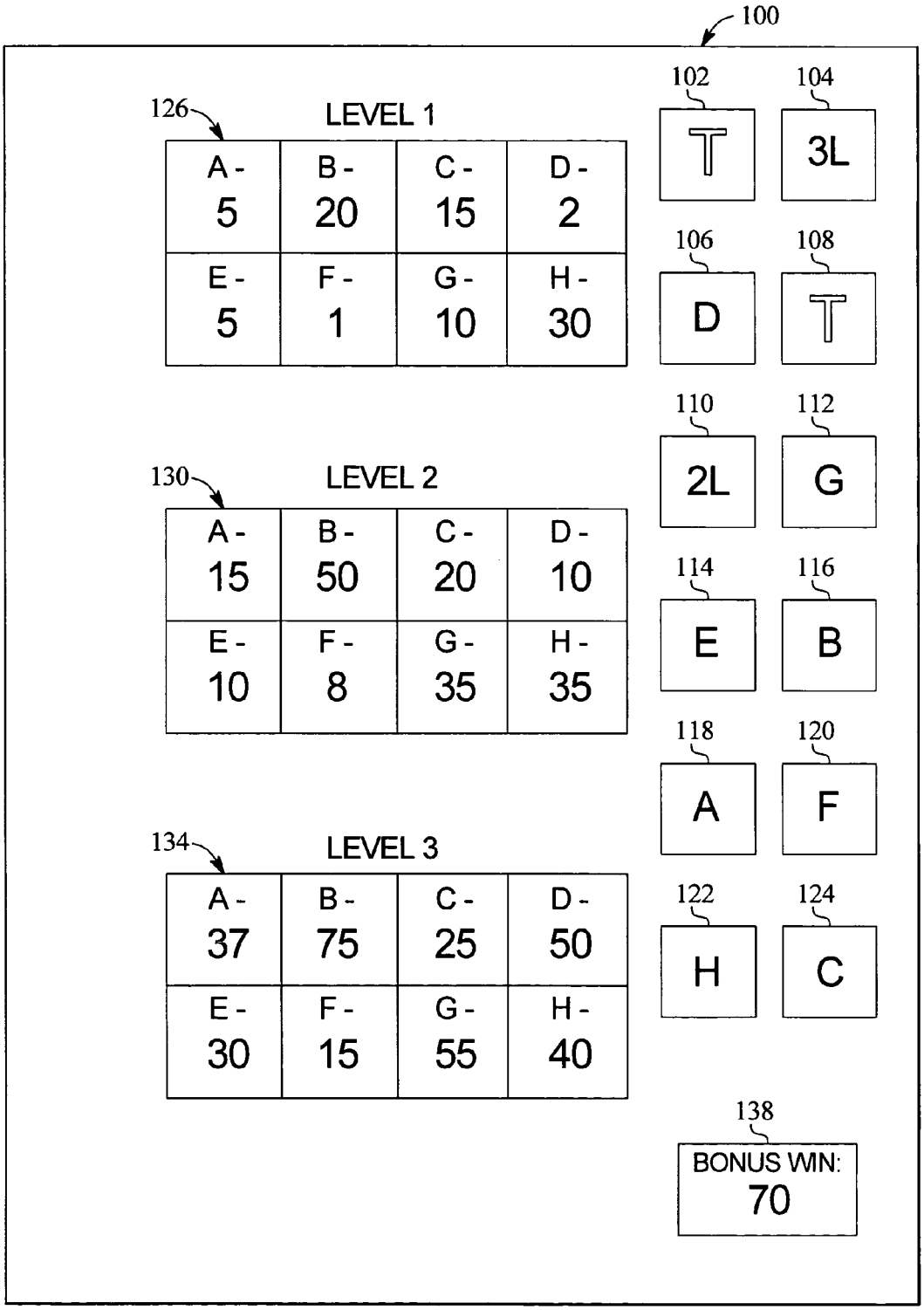

In one embodiment, as illustrated in FIG. 4D, at the conclusion of the selection game the gaming device reveals the award or value associated with each of the symbols for each of the levels. This embodiment increases the player's level of excitement because it shows the player the different awards and values the player might had obtained if the player had picked different selections. It should be appreciated that the award associated with one symbol for one level need not be mathematically related to the award associated with the same symbol for another level. Unlike the embodiment described above wherein there is a relationship between the revealed award and each activated modifier (i.e., the revealed award multiplied by each activated modifier), in this embodiment, the award associated with each symbol for each level may be independently determined. For example, the award of ten associated with the "D" symbol of the second level is not related to and is determined independently of the award of two associated with the "D" symbol for the first level and the award of fifty associated with the "D" symbol for the third level.

Referring generally to FIGS. 5A to 5D, in another embodiment of the present invention, the gaming device provides a plurality of awards or values. Each of the plurality of awards or values is paired or matched up with another one of the plurality of awards to form a set or pair. In this embodiment, each award in each set or pair is related or linked to the other award in the set or pair. For instance, in one set, the first award of a set is a value and the second award of the set is the first value modified by a modifier. The gaming device also provides at least one terminator.

Figure 5A:
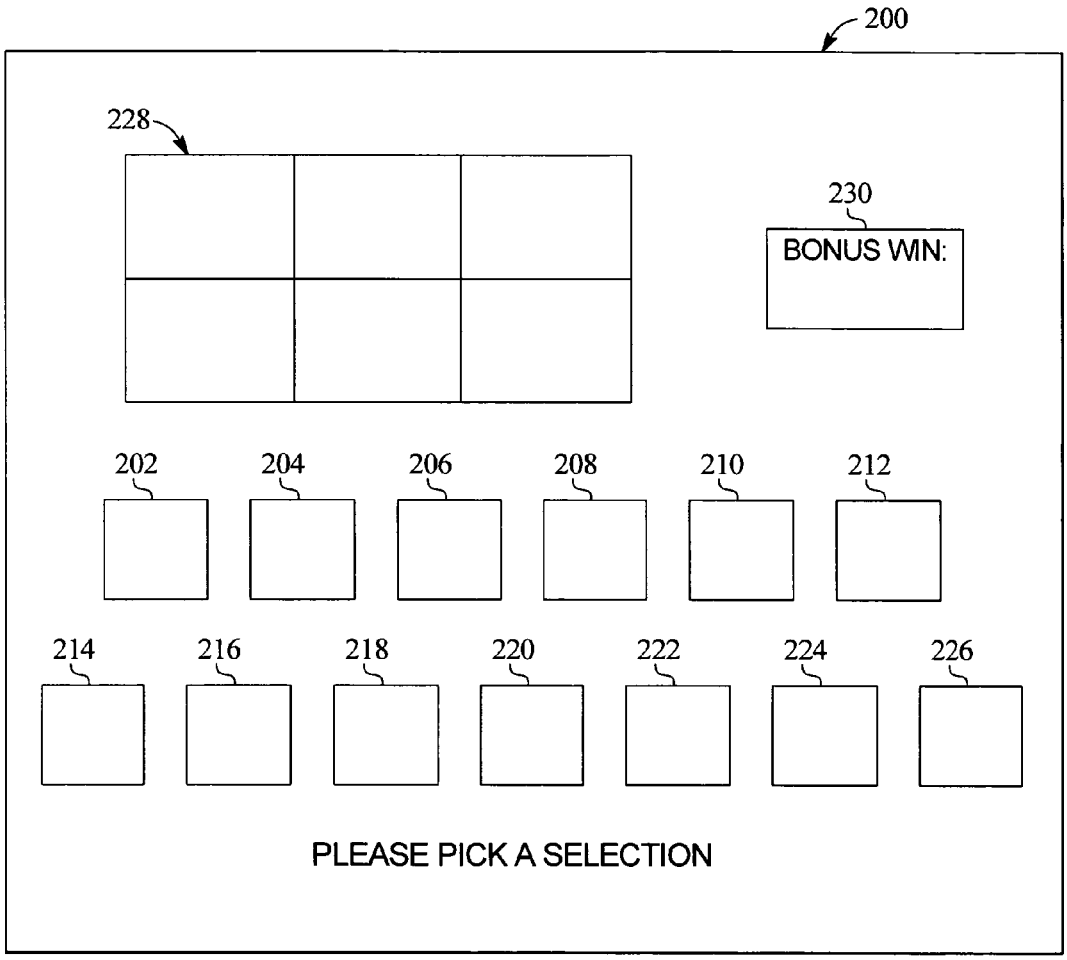
FIGS. 5A, 5B, 5C and 5D are front elevational views of an alternative embodiment of the present invention illustrating a player provided an award based on a plurality of picked values.

As illustrated in FIG. 5A, in this embodiment, the gaming device provides a screen or display 200 which enables a player to make selections to obtain an award. The gaming device indicates or provides a plurality of selections 202, 204, 206, 208, 210, 212, 214, 216, 218, 220, 222, 224 and 226. Each of the plurality of awards are associated with one of the selections and each of the terminators are associated with one of the selections. The gaming device also provides a board or grid 228 with a plurality of positions wherein each award is associated with one of the positions of the board. Moreover, the gaming device provides an award amount counter or display 230 that displays the award amount provided to the player during the selection game.

As seen in FIG. 5A, the gaming device enables the player to pick one of the plurality of selections. The award or terminator associated with the picked selection is revealed to the player. Appropriate messages such as "PLEASE PICK A SELECTION" are provided to the player visually or through suitable audio or audiovisual displays.

Figure 5B:
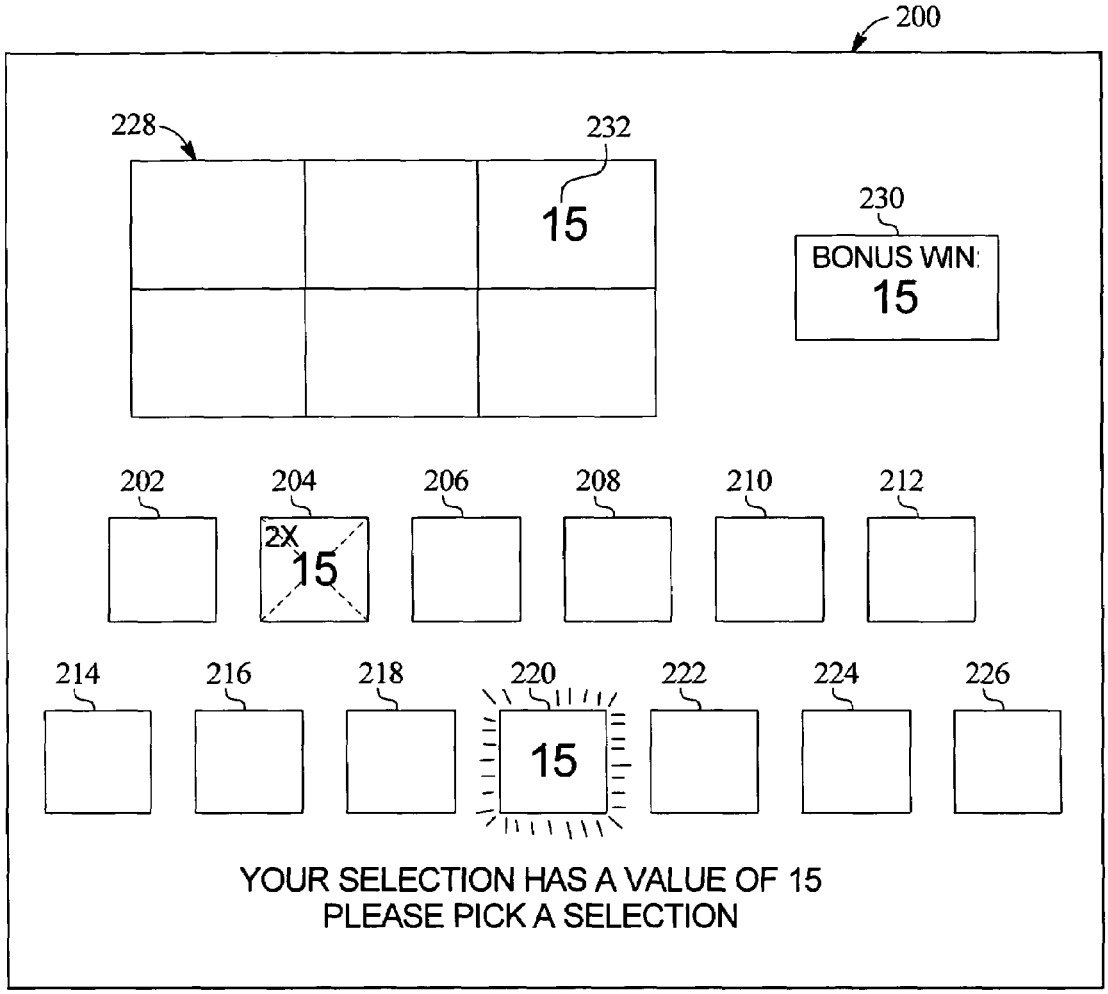

As illustrated in FIG. 5B, the player picked highlighted selection 220 which is revealed to be associated with an award of fifteen. Accordingly, the revealed award of fifteen is displayed on the board at the position 232 associated with the award of fifteen and the award amount display displays the award amount of fifteen. Moreover, the modified award related to the revealed award 204 is also revealed. It should be appreciated that once the related award is revealed to the player, the award related to the revealed award is marked or flagged. That is, the player cannot pick the selection associated with the related award on a subsequent pick of the selections (as indicated by the strikethrough). Since a terminator was not revealed and at least one selection remains masked, the gaming device enables the player to pick another one of the masked selections. Appropriate messages such as "YOUR SELECTION HAS A VALUE OF 15" and "PLEASE PICK A SELECTION" are provided to the player visually or through suitable audio or audiovisual displays.

Figure 5C:
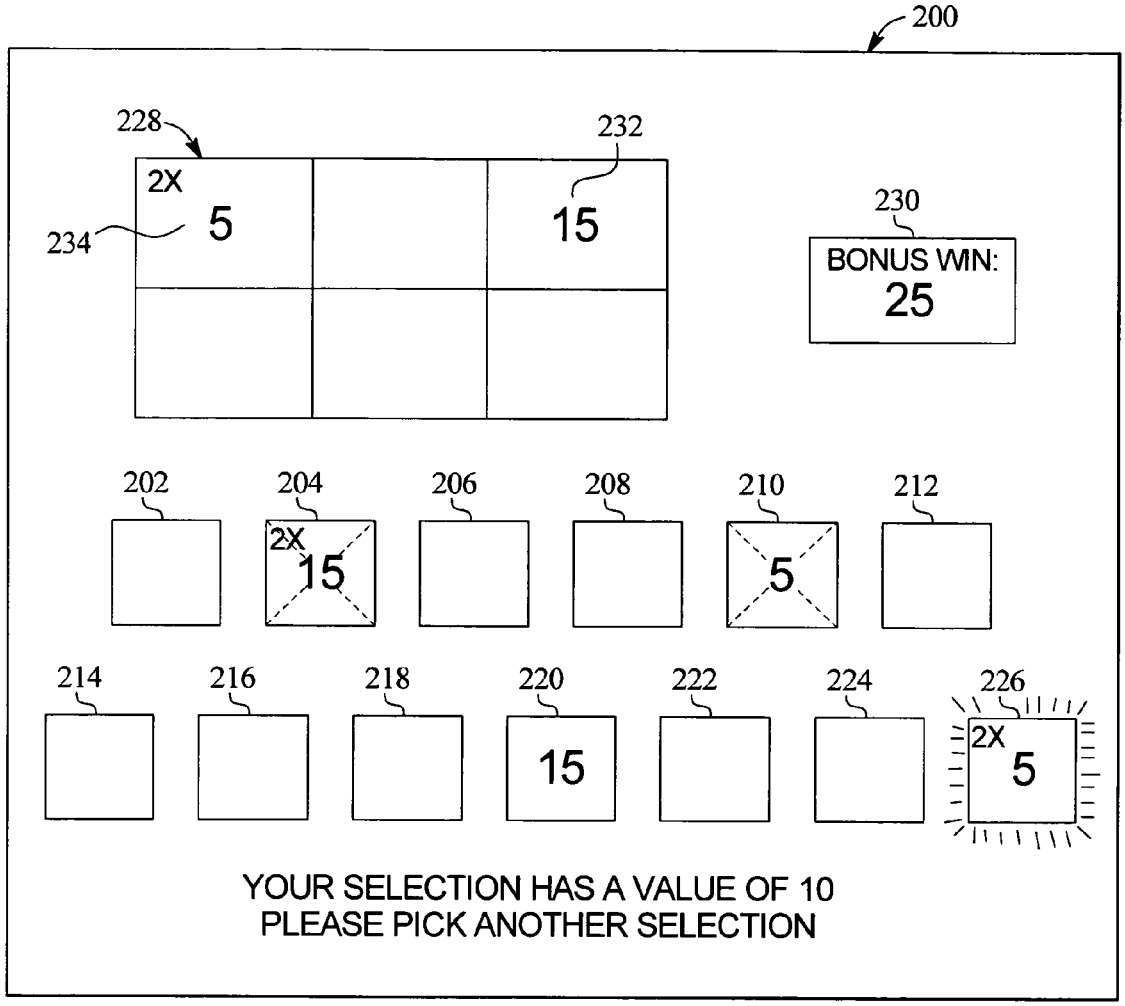

As illustrated in FIG. 5C, the player picked highlighted selection 226 which is revealed to be associated with an award of ten. It should be appreciated that the this revealed award of ten is the modified award that is related to the unmodified award of five. Accordingly, the revealed award of ten is displayed on the board at the position 234 associated with the award of ten and the award amount display displays the award amount of ten. Moreover, the unmodified award related to the revealed modified award 210 is also revealed. Since a terminator was not revealed and at least one selection remains masked, the gaming device enables the player to pick another one of the masked selections. Appropriate messages such as "YOUR SELECTION HAS A VALUE OF 10" and "PLEASE PICK A SELECTION" are provided to the player visually or through suitable audio or audiovisual displays.

Figure 5D:
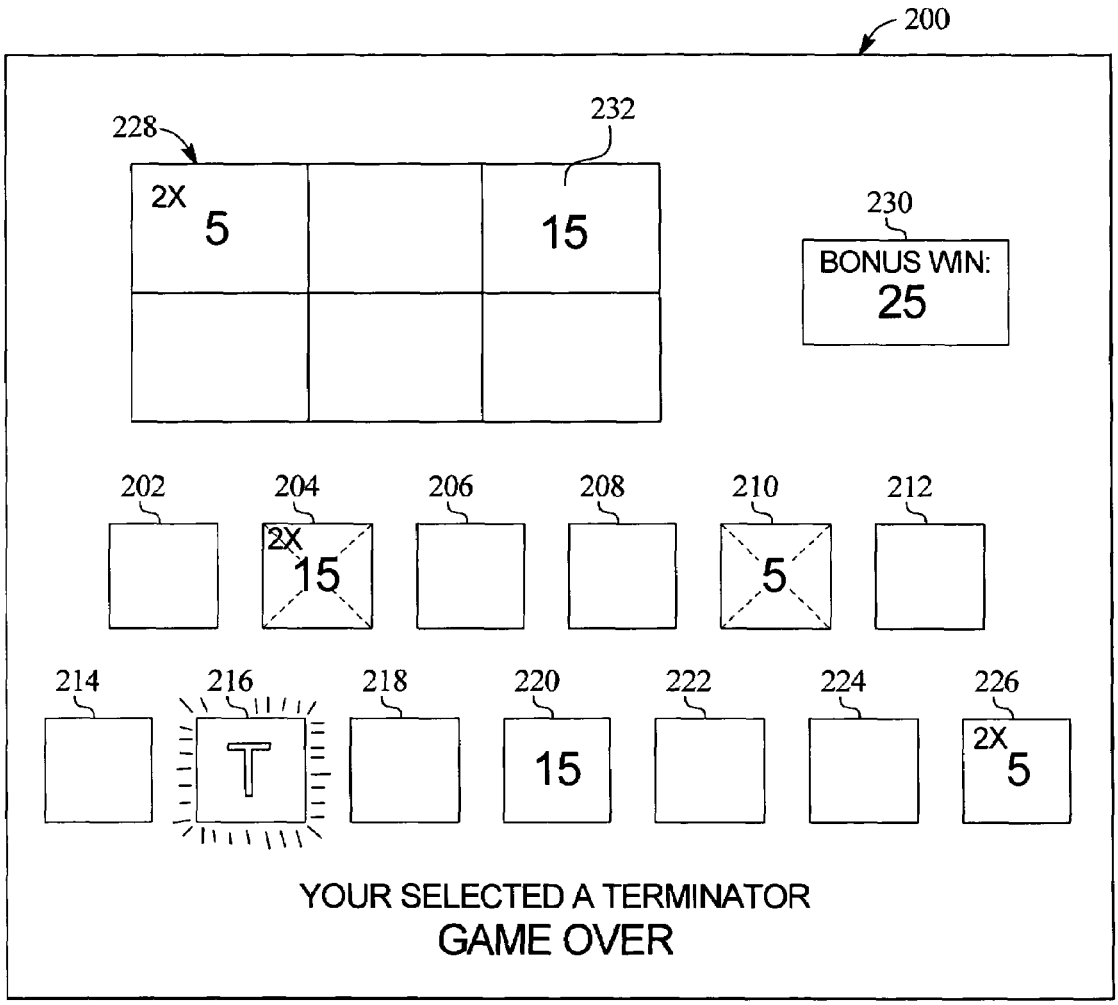

As illustrated in FIG. 5D, the player picked highlighted selection 216 which is revealed to be associated with a terminator. If a player obtains the terminator, the gaming device will provide no award, provide the player a consolation award or select another award to provide the player. Accordingly, the selection game ends and appropriate messages such as "YOU SELECTED A TERMINATOR" "YOUR TOTAL AWARD IS 25" and "GAME OVER" are provided to the player visually or through suitable audio or audiovisual displays.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

at least one display device;

at least one input device;

at least one processor; and at least one memory device which stores a plurality of instructions, which when executed by the at least one processor, cause the at least one processor to operate with the at least one display device and the at least one input device to:

(a) cause one of a plurality of selections to be picked, wherein:

(i) a plurality of said selections are associated with a plurality of award values, and (ii) prior to any of the selections being picked:

(A) at least one of said plurality of selections is associated with at least one initially inactivated modifier of a plurality of different modifiers, and (B) the plurality of different modifiers includes at least one initially activated modifier;

(b) thereafter, reveal any award value or modifier associated with the picked selection;

(c) if said picked selection is revealed to be associated with one of said award values, modify the revealed award value by each of said activated modifiers, wherein each activated modifier and said revealed award value form a separate modified award value;

(d) if said picked selection is revealed to be associated with one of said at least one inactivated modifier:

(i) activate the revealed modifier; and (ii) retroactively modify any previously revealed award values by said activated revealed modifier, wherein each previously revealed award value and said activated revealed modifier form a separate modified award value;

(e) thereafter, display any modified award value;

(f) thereafter, repeat steps (a) to (e) until a termination event occurs; and (g) when the termination event occurs, provide any modified award value.

2. The gaming device of claim 1, wherein when executed by the at least one processor, the plurality of instructions cause the at least one processor to cause said termination event to occur when a number of picks of said selections is reduced to a designated number.

3. The gaming device of claim 1, wherein when executed by the at least one processor, the plurality of instructions cause the at least one processor to operate with the at least one display device to associate at least one terminator with at least one of said selections, wherein if said terminator is associated with the picked selection, said terminator associated with the picked selection is revealed.

4. The gaming device of claim 3, wherein when executed by the at least one processor, the plurality of instructions cause the at least one processor to cause said termination event to occur if said terminator is associated with the picked selection.

5. The gaming device of claim 1, wherein when executed by the at least one processor, the plurality of instructions cause the at least one processor to cause said termination event to occur if each of said plurality of award values and each modifier is revealed.

6. The gaming device of claim 1, wherein the plurality of modifiers include a plurality of initially activated modifiers.

7. The gaming device of claim 1, wherein each of said modifiers are different.

8. The gaming device of claim 1, wherein when executed by the at least one processor, the plurality of instructions cause the at least one processor to display a plurality of boards, wherein each board is associated with a different one of said modifiers.

9. The gaming device of claim 8, wherein when executed by the at least one processor, the plurality of instructions cause the at least one processor to activate each board associated with each activated modifier, wherein each activated board displays any modified award value that is based on the associated activated modifier.

10. The gaming device of claim 1, wherein when executed by the at least one processor, the plurality of instructions cause the at least one processor to enable a player to pick said selections.

11. A method of operating a gaming device including a program, said method comprising:

(a) causing at least one processor to execute said program to activate at least one of a plurality of different modifiers;

(b) causing at least one display device to display a plurality of selections, wherein prior to any of the selections being picked: (i) a plurality of said selections are associated with a plurality of different award values, and (ii) at least one of said selections is associated with at least one remaining inactivated modifier;

(c) causing one of the plurality of selections to be picked, (d) thereafter, causing the at least one display device to reveal any award value or inactivated modifier associated with the picked selection;

(e) if said picked selection is revealed to be associated with one of said award values, causing the at least one processor to execute said program to modify the revealed award value by each of said activated modifiers, wherein each activated modifier and said revealed award value form a separate modified award value;

(f) if said picked selection is revealed to be associated with said inactivated modifier, causing the at least one processor to execute said program to: (i) activate the revealed modifier, and (ii) retroactively modify any previously revealed award values by said activated revealed modifier, wherein each previously revealed award value and said activated revealed modifier from a separate modified award value;

(g) thereafter, causing the at least one display device to display any modified award value;

(h) thereafter, causing the at least one processor to execute said program to repeat steps (c) to (g) until a termination event occurs; and (i) when the termination event occurs, providing any modified award value.

12. The method of claim 11, which includes enabling a player to pick said selections.

13. The method of claim 11, wherein said termination event occurs if a number of picks of said selections is reduced to a designated number.

14. The method of claim 11, wherein said termination event occurs if a terminator is associated with the picked selection, wherein if a terminator is associated with the picked selection, said terminator is revealed.

15. The method of claim 11, wherein said termination event occurs if each of said plurality of award values and each modifier is revealed.

16. The method of claim 11, which includes causing the at least one display device to display said modified award values on a plurality of boards, wherein each board is associated with one of said modifiers.

17. The gaming device of claim 16, which includes causing the at least one processor to execute said program to activate each board associated with each activated modifier, wherein each activated board displays any modified award value that is based on the associated activated modifier.

18. The method of claim 11, which is provided to a player through a data network.

19. The method of claim 18, wherein the data network is an internet.

* * * * *